United States Patent [19]

Eickmann

[11] 4,193,336

[45] Mar. 18, 1980

[54] RADIAL PISTON MACHINE WITH FREE-FLOATING PISTON AND PISTON-SHOE ASSEMBLIES

[76] Inventor: Karl Eickmann, 2420 Isshiki, Hayama-machi, Kanagawa-ken, Japan

[21] Appl. No.: 765,221

[22] Filed: Feb. 3, 1977

Related U.S. Application Data

[63] Continuation-in-part of Ser. No. 528,346, Nov. 29, 1974, Pat. No. 4,037,523.

[30] Foreign Application Priority Data

May 14, 1974 [AT] Austria ..... 3991/74

[51] Int. Cl.[2] ..... F01B 1/06; F01B 13/06; F01B 31/00

[52] U.S. Cl. ..... 91/488; 91/491

[58] Field of Search ..... 91/488, 491, 492; 92/187, 191

[56] References Cited

U.S. PATENT DOCUMENTS

| | | | |
|---|---|---|---|
| 2,698,585 | 1/1955 | Cotner et al. | 91/491 |
| 3,151,529 | 10/1964 | Leath | 91/491 |
| 3,223,046 | 12/1965 | Eickmann | 91/488 |
| 3,760,690 | 9/1973 | Freeman | 91/491 |
| 3,828,653 | 8/1974 | Aldinger et al. | 91/488 |
| 3,885,457 | 5/1975 | Bosch | 91/488 |
| 3,961,562 | 6/1976 | Kersten et al. | 91/492 |

*Primary Examiner*—John J. Vrablik

[57] ABSTRACT

A radial-piston machine has a rotor formed with a plurality of each a piston carrying radial cylinders. Each such piston is formed on its radially outer end with a part-spherical seat and a part-spherical portion of a respective piston shoe that rides on an eccentric cam in the housing is engageable in each seat. Each such piston shoe can move radially into and out of engagement with the respective piston. A pair of end members axially flank the piston shoes with play so that these shoes may also move axially relative to the motor. The piston-engaging portions of the shoes are always engaged radially in said cylinders. The cylinders may have outer portions with a cross-slot extending parallel to the axis of the rotor through said cylinders. The pistons and shoes may embrace each other partially or be radially free of each other, so, that either the connected piston and piston shoe assembly moves radially between end elements associated to the rotor or the pistons and shoes move unconnected to each other radially between said end elements. The piston shoes may have one- two- or three-dimensional free play.

4 Claims, 34 Drawing Figures

Fig. 1
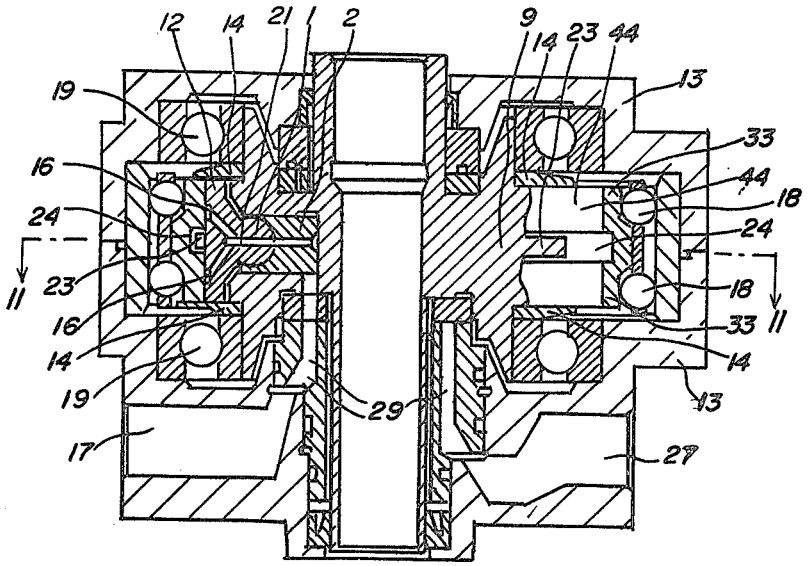
Fig. 2
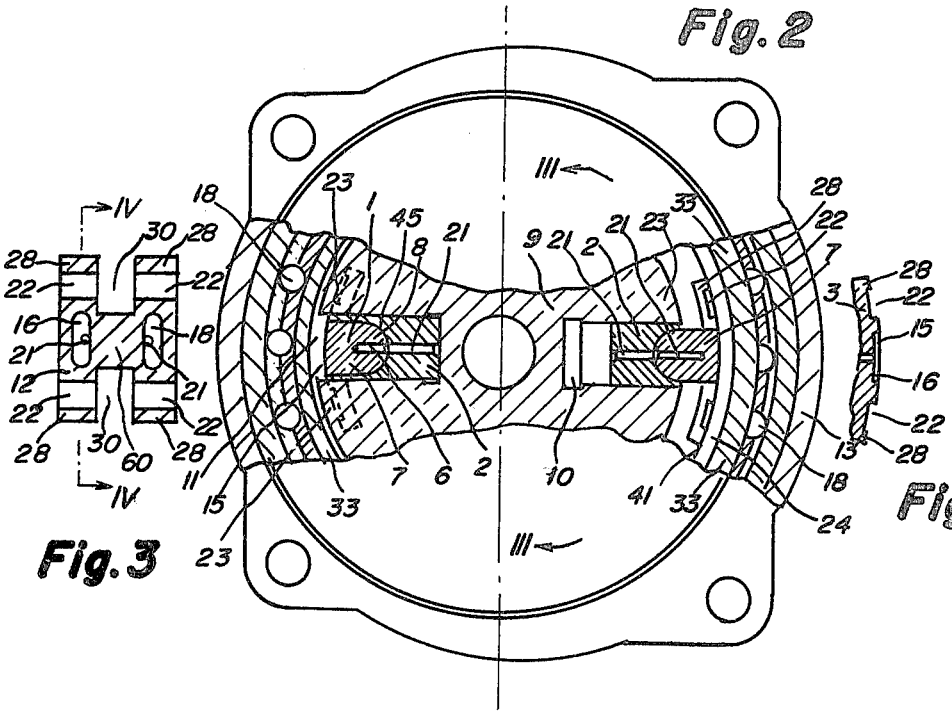
Fig. 3
Fig. 4

Fig. 9
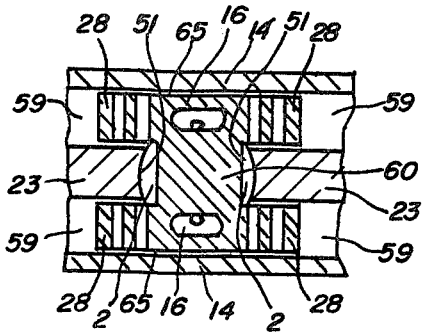
Fig. 10
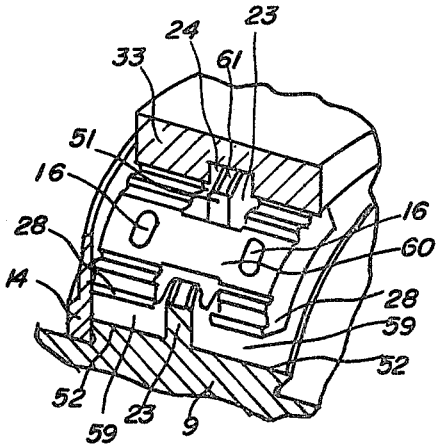
Fig. 11
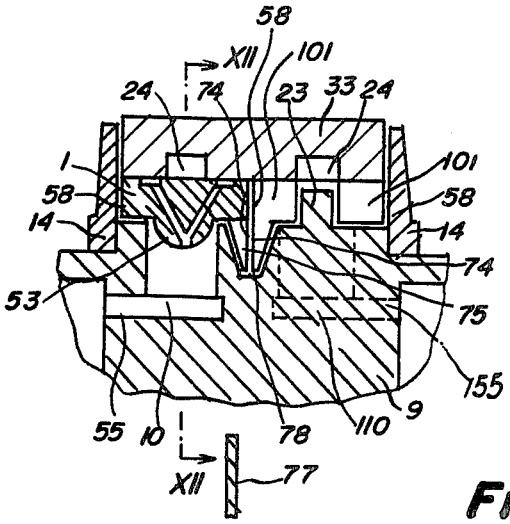
Fig. 12
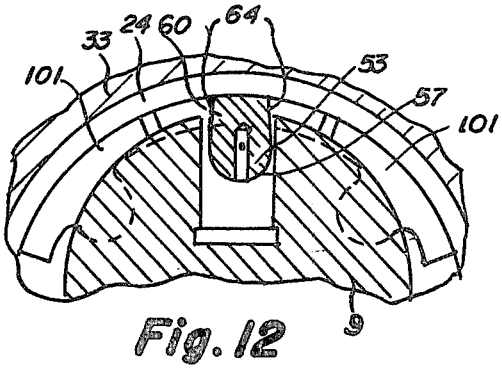
Fig. 13
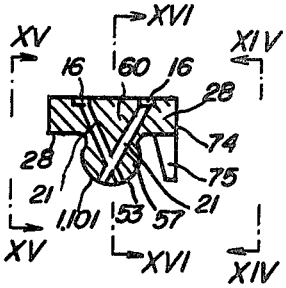
Fig. 14
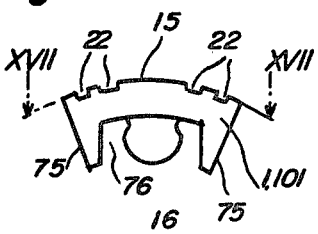
Fig. 15
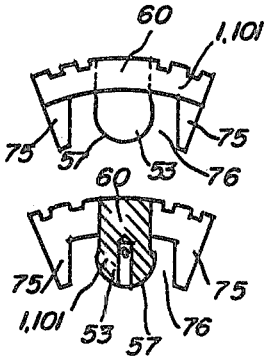
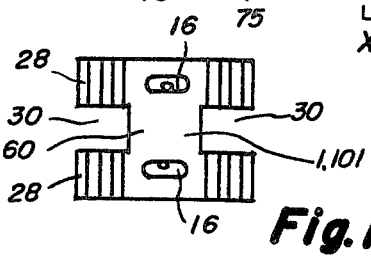
Fig. 17
Fig. 16

Fig. 18
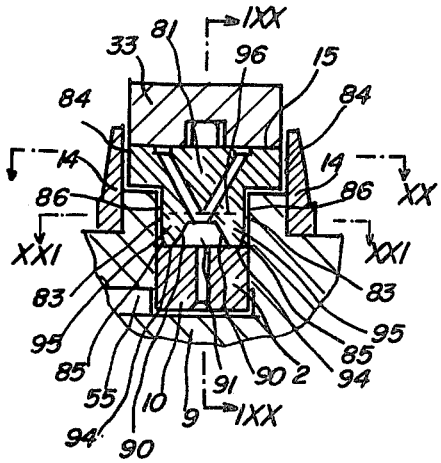
Fig. 19
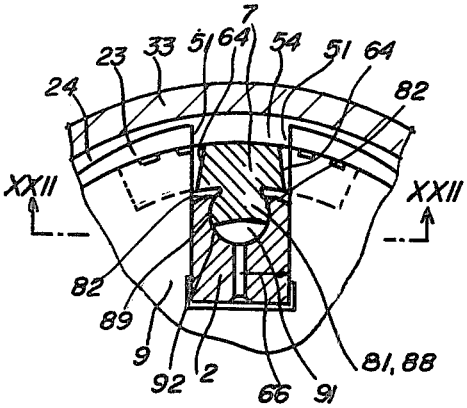
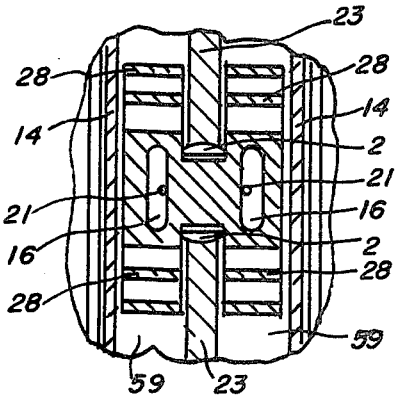
Fig. 20
Fig. 22
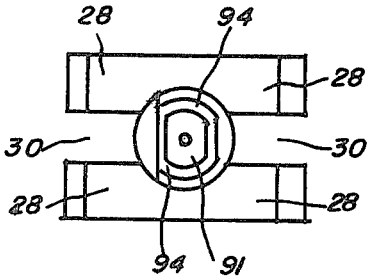
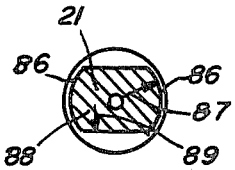
Fig. 21

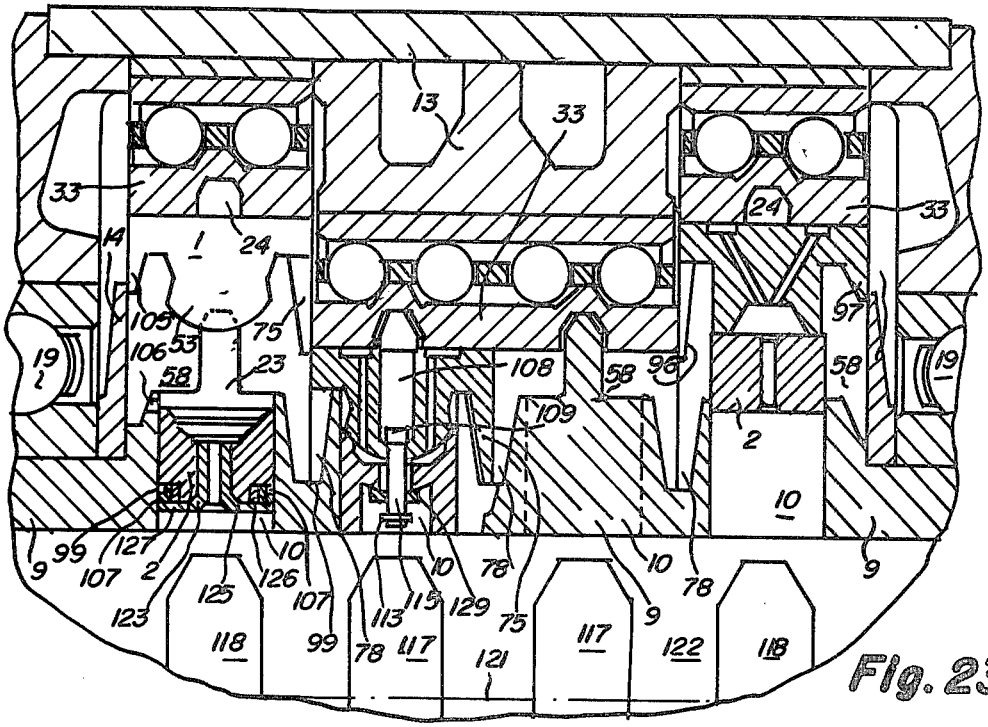
Fig. 23
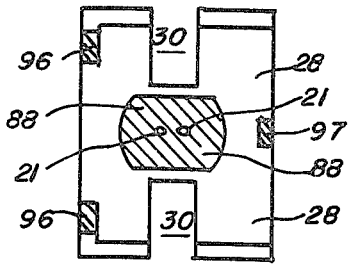
Fig. 25
Fig. 27
Fig. 26
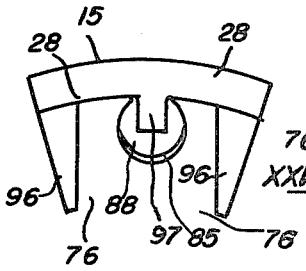
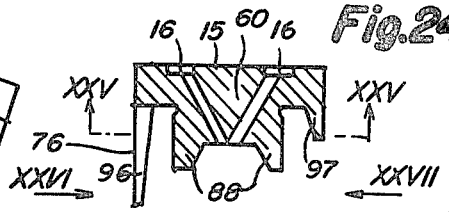
Fig. 24
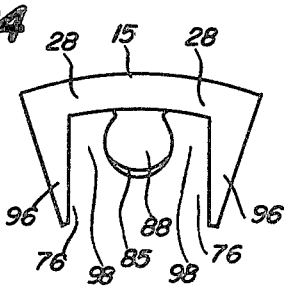
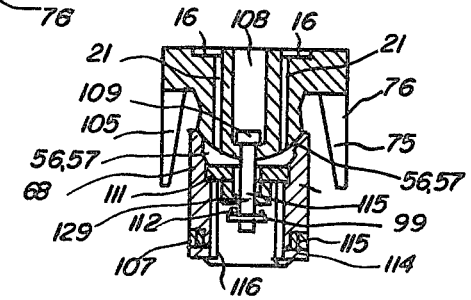
Fig. 28

RADIAL PISTON MACHINE WITH FREE-FLOATING PISTON AND PISTON-SHOE ASSEMBLIES

CROSS REFERENCE TO RELATED APPLICATION

This is a continuation in part patent application of my earlier application Ser. No. 528,346 of Nov. 29, 1974; now U.S. Pat. No. 4,037,523.

FIELD OF INVENTION

This invention relates to an entering or deep-diving piston shoe with a central radial support member or support portion and means to secure this piston shoe in a radial piston type fluid-handling device wherein fluid flows through substantially radially arranged cylinders of the fluid-handling body of the device. This invention is related to such radial chamber fluid handling devices which have piston shoes which can center at least partially into the respective cylinders or into the fluid-handling body or rotor of the device or which dive beyond the outermost or innermost diameter of the fluid-handling body or radial extensions thereof deeply into the respective cylinders or cylinder portions.

SUMMARY OF THE INVENTION

One embodiment of the invention consists in that a piston-shoe with a radial support member is provided in a fluid-handling piston device and/or the piston shoes are provided with at least one-dimensional free play, or with three-dimensional free play, or with at least one-dimensional or multi-dimensional movability.

According to another embodiment of the invention the piston shoes and pistons are self-assembling or themselves automatically assembling. This means that both the pistons and the piston shoes are radially movable independently of each other; and that they are not connected with each other and that they, when pressure appears in the respective cylinder of the fluid handling body or rotor, are forced against each other automatically, whereby they associate and fit to each other. In order that the pistons and piston shoes remain in their respective locations and that they do not escape from their provided locations or from their containment spaces they must be provided as described in detail in this specification.

In order to assure the above mentioned self-assembly of the pistons and piston shoes of the fluid handling radial piston device an important embodiment and object of the invention consists in that the piston shoe is provided between the piston stroke actuator means, the fluid handling body or rotor and the end walls, and with at least a portion of its radial support member between radially extending sectors or portions of the fluid-handling body or rotor of the device.

The aim of the invention is to provide a piston shoe in a radial-piston type fluid-handling device which is radially so strong that it can operate in the device with very high pressure in the fluid and which at the same time allows a maximum of rate of flow through the device and which also at the same time is very effective in operation with a minimum of losses. It is especially preferred to make the piston piston-shoe assembly self-assembling or moveable in at least one or a multiple of dimensions to give it free play in at least one dimension. The one or multi-dimensional free play consists at least in radial free play of the connected or unconnected piston and piston shoe in a radial direction and in the case of multi-dimensional free play also in an axial free play of the piston shoe and/or in an axial and tangential or peripheral free play of the piston shoe. In its most advanced forms the piston shoes have three-dimensional free play, namely, radial, axial and peripheral free play. It is thereby the aim of this invention to provide the radial-piston fluid-handling device with very high efficiency, very reliable operation, with a capacity to handle highest pressures in fluid, and in preferred embodiments also with highest rotary velocity and/or rate of flow through the device of a given size or weight. It is thereby the aim and object of this invention to increase the power and in most cases also the efficiency of a radial piston device of a given size or weight. At the same time the power at a given weight will be increased by the aims and objects of the invention. It is also the aim or object of this invention to increase the power of radial-piston type fluid-handling devices by means of a piston of such simple design and structure as to be easily manufactured and irexpensive during the manufacturing process. However, in order to obtain the aims or objects of this invention, the fluid-handling radial piston device must be built and be of such structure that the piston shoe of the invention can be assembled in it and be used in it. Thereby it might be necessary according to another object or objects of the invention, to provide guides, faces, end members and/or other means in conjunction with the piston shoes of the invention.

BACKGROUND OF THE INVENTION

There are many different piston shoes known in radial-piston type fluid-handling devices. These piston shoes have been of different structure and function. Most of them have operated satisfactorily in fluid-handling devices of certain pressures in the fluid in the devices.

It is also known to provide support means or guide means for the piston shoes of the prior art. Some piston shoes are already "entering piston shoes" which means that they enter at least partially into the fluid-handling body or cylinder-containing body of the device. However, as well as the best known piston shoes have operated at certain pressures in fluid, strokes in the device or speeds of the moving parts or power, size or efficiency of the known devices, they still have not obtained the maximum possible powers, efficiencies, pressures in fluid or rate of flow of fluid through the device of a given size or weight.

It is therefore another aim and object of this invention, to increase the power and/or efficiency of radial-piston devices without increasing their outer sizes or weights. It is the aim to increase at least the power to higher powers and/or efficiencies than those ever obtained in radial-piston fluid-handling devices of the known type.

It is also known to connect pistons and piston shoes so that the piston shoes can swing or pivot in the respective connection means of the pistons. In as far as these piston shoes can enter or deeply dive into the cylinder or fluid handling body of the device, they operate with large piston strokes and through flow or rate of flow of fluid through the device. However, in order to connect a piston shoe pivotally or swingably with a piston one or both has to embrace the other at least to a limited extent. Since otherwise the piston and piston shoe would not be connected together with an ability to swing or pivot relatively to each other or on each other. This embracing of one part by the other needs a certain portion of the cross-sectional area of at least one of the parts. It thereby limits the maximum cross-sectional area or bearing area of the bearing faces of the piston piston shoe swing or pivot connection of the piston and piston shoe assembly. Consequently in these piston piston-shoe assemblies only a fraction of the cross-sectional area of the piston could be utilized for the provision of a bearing means or bearing faces between the piston and piston shoe for bearing on each other. Another fraction of the cross-sectional area of the piston remains for the swing or pivot connection between the piston and piston shoe for the embracing of one of the parts by the other. Since accordingly in these known devices or piston piston shoe assemblies only a portion of fraction of the cross-sectional area of the piston can be utilized for the provision of a bearing or bearing faces on or between the piston and piston shoe, a piston piston-shoe assembly of this known kind can never obtain the same high pressure capability which a piston piston-shoe assembly can obtain where the whole or almost the whole cross-sectional area of the piston is utilized for the provision of the bearing means between the piston and piston shoe of the assembly.

It is therefore another aim and/or object of this invention, to provide a radial piston device which is capable of operating at higher fluid pressures because a bearing area is provided between the pistons and piston shoes of the device which is increased over the size of the known cross-sectional relative areas of bearing means of pivotal operating pistons and/or piston shoes of the prior art. Accordingly the bearing area or bearing face areas may be increased by this invention to extend almost or wholly over the whole cross-sectional area of the piston.

Some radial piston devices already use great cross-sectional areas for the bearing means between the pistons and piston shoes. However, in these devices the piston shoes extend beyond the cross-sectional area of the associated pistons. Thus they extend over the cross-sectional areas of the pistons and cylinders. Consequently they need for their motion and operation a special space which has to be wider than the diameter of the cylinders and pistons. These known arrangements therefore require either a shorter piston stroke in a device of the given size or they require a bigger diameter of the fluid-handling body for the provision of the required wider space. The latter necessitates a bigger diameter of the device and therefore an increase in its size and weight for a given size of piston stroke and thereby of rate of flow through the device. Both requirements result in any case in a device of a given size and weight in a reduction of the rate of flow of fluid through the device. The known wider bearing provisions of the art therefore resulted in a reduction of the rate flow capability of the devices. With the required restriction of the rate of flow through the device of a given size and weight these devices of the known type also restrict the power of the devices in a given size and weight.

It is also an aim and object of this invention not only to increase the cross-sectional area of the bearing faces between the piston and piston shoe, but also at the same time to obtain a high-pressure capability in a radial-piston type fluid-handling device of highest rate of flow or volumetric capacity at a given size and/or weight of the device. It is therefore the aim of the invention to obtain a high-pressure capability and at the same time and in the same device a high volumetric or flow through capability.

The radial piston devices of the prior art, which have piston shoes which are pivotally connected to the pistons are not easy to manufacture. They are complicated to machine and thereby also expensive. The known radial piston devices of the former type which have piston shoes of high bearing capacity extending beyond the diameter of the pistons and cylinders need space for their location and movement, which in turn has rotors of bigger diameters for a given piston stroke necessary. Thereby these devices become heavy, voluminous and big for a given piston stroke or flow through or volumetric capability. Thereby also these devices become expensive and complicated.

It is therefore a further aim and object of this invention to provide a radial piston device, which has the features of the other aims of the invention but which is in addition also easy to manufacture and inexpensive due to the small size and weight of material for a given power.

The aim and object of the invention is therefore, either a single improvement or the solution of one or more aims of the invention, singly or in combination; for example:

an increase of the cross-sectional area of the bearing faces between piston and piston shoe in order to obtain a radial strength and thereby high-pressure fluid handling capability of the device;

an increase of the radial bearing force capability of the device;

a high pressure device of at the same time high volumetric flow through capability;

an improvement of the increase of the volumetric flow through capability of a device of a given size and weight;

an increase of the piston stroke of high-pressure piston shoes in a rotor of a given diameter in a radial piston fluid handling device;

and/or the provision of a simple fluid handling device which is easy to manufacture, inexpensive or less in weight and size for a given power or stroke of fluid handling devices with piston shoes which are pivotally associated to the respective pistons of the device.

One of the aims and objects of the invention is achieved in that in a radial-piston type fluid-handling device with piston shoes which are swingably associated to pistons of the device, end wall means are provided on or associated with the rotor or piston stroke actuator means for the prevention of escape of piston shoes out of their associated spaces and the provision of a radial support member on the medial portion of the piston shoe which forms together with the associated piston bearing faces of a constant radius around a common mean, and which extends so far radially towards the piston that at least a portion of the medial support radial extension of the piston shoe remains at all times of the piston stroke between portions of the rotor or of segments or radial extensions of the rotor.

Another aim and object of the invention is achieved in that the pistons and piston shoes remain unconnected so that they can fit together when pressure appears in the respective cylinder which forces the piston and piston shoe together for engaging each other at their bearing faces of common radius around a common mean.

The aims and objects of the invention are achieved to maintain a device of high rate of flow or volumetric capability while at the same time enabling a high radial strength of the pistons and piston shoes and thereby a capability of them to operate with fluid of very high pressure.

Another aim and object of the invention is to use a piston shoe which has a central portion which bears on its ends piston-shoe guide portions and recesses to both sides of the central portion in directions of rotation and contrary thereto and interrupting the guide portions of the piston shoes in two end portions for the reception of rotor-radial segments or portions of the rotor of the device. The rotor segments or portions may also be called rotor-radial extensions. Thus in order that the peripheral intersecting recesses are provided in the piston shoe to both sides of the medial piston shoe portion and between the end guide portions of the piston shoe, the piston shoe can enter completely into the cylinder portions of the rotor deeply beyond the outermost or innermost diameter of the rotor's radial extensions if the radial extensions of the rotor are provided and if they are narrower than the recesses or intersecting recesses of the piston shoes. This feature provides the desired large piston stroke of the device and thereby the desired large rate of flow or volumetric capacity of the device.

Another aim and object of the invention is achieved in that a large portion of the cross-sectional area of the piston is utilized for forming the bearing faces between piston and piston shoe which are pivotable on each other. Thereby great radial strength of these members is obtained. Because a bigger bearing face can exert more force and also because a cross-sectionally bigger piston shoe radial extension can bear a higher radial force and pressure than a smaller cross-sectional area radial extension. In order to obtain this aim the connection between the pistons and piston shoes is eliminated in this embodiment of the invention. A piston piston-shoe connection would need a portion of the cross-sectional area of the pistons or a respective one of the piston shoes, if one of them embraces the other. The embracing of the piston shoe portion by the piston or the embracing of the piston portion by the piston shoe, which is required in order to connect the pistons and piston shoes pivotably together by the embracing of one of the other and which takes a portion of the cross-sectional area of the piston away from the bearing faces between the pistons and piston shoes, is spared by this embodiment of the invention and thereby the area of the bearing faces between the pistons and piston shoes is increased.

Another feature of the invention is that the bearing between piston and piston shoe consists of a hollow ball-shaped recess in the top of the piston and in a substantial semi-spherical shape of the radial outer end of the radial support portion of the piston shoe. Thus three objects are achieved, namely: a simpler form of the bearing means between piston and piston shoe which can be easily and inexpensively be machined; the highest bearing capacity between piston and piston shoe by using the maximal possible extension of the cross-sectional area of the bearing faces between piston and piston shoe relative to the cross-sectional area of the piston, and finally that at least one portion of the piston shoe radial extending support portion remains within the inner radial confines of the outermost radial extension of the rotor extensions so that the maximum of possible piston stroke for high rate of flow volumetric capacity is obtained and at the same time any tangential escape of the piston shoe out of its associated space is and remains prevented.

Another feature of the invention is that at all locations during the maximum extent of the piston stroke at least a portion of the bearing face between the pistons and piston shoes remains within a portion of the cylinder or cylinder-face extension of the device.

A further aim and object of the invention is achieved in that the medial piston-shoe portion, which may also be called the piston-shoe central portion, is integral with the radial support extension of the piston shoe and with the guide portions of the piston shoe axial ends outside the intersecting recesses on both sides of the central portion extending peripherally or tangentially. This one-piece integration supplies also the needed strength for radial rigidity and thereby for radial force-transmitting capability, which results in high pressure capability for the handling of high-pressure fluid.

A still further aim and object of the invention is achieved in that the diameter of the face of the piston stroke actuator means turned toward the rotor is at least a little but greater than the diameter of the rotor at the actuator, and that the radial extension of the piston shoe is a little bit larger than the size of the piston stroke, or than 2e of the device, wherein e is the eccentricity between the axis of the rotor and the axis of the actuator means. This characteristic of this feature of the invention assures that at all times and locations the piston and piston shoe can fit into each other automatically again. This provision prevents any escape of the non-connected piston shoe out of its associated space.

Another feature of this invention is that at the ends of a space for containment of the piston shoes end walls or end faces are provided which may be attached to respective end shoulders of the rotor or of the actuator. Thereby the axial escape of the piston shoe out of this space for containing the piston shoes is prevented.

Closely related to the above is another feature of the invention which consists in that a piston shoe containment space is provided between the rotor, the actuator, and end walls of the device.

According to a further feature of the invention the end walls or end faces are extended so wide radially that they at all times embrace at least a portion of each piston shoe. Thus the piston shoes are held within the respective containment spaces between the end walls or end members.

High mechanical efficiency of the device of the invention with less friction or a minimum of friction is achieved in that a small clearance space is provided between the outermost axial ends of the piston shoes and the innermost faces of the end members, walls, or faces.

Common to all of the provisions for attaining an aim or object or aims or objects of the invention is the location of the piston shoes between the actuator means, the rotor, and end members and that at the same time at least a portion of the radial support extension member of the piston shoe is provided within a cylinder or at least between a pair of radial extensions or segments of the rotor of the device.

Another provision for attaining an aim or object of the invention consists in keeping the pistons and piston-shoes unconnected and keeping them freely movable independent of one another in order to assure an especially safe and reliable operation of the radial-piston fluid-handling device. Thus assures that the device can continue to operate even if one or more of the pistons sticks within the respective cylinder. If a piston sticks, the piston shoe can separate from the sticking piston and freely float within its associated piston-shoe containment space. Any breaking of pistons and piston-shoes, which occurred in earlier devices, is thereby prevented. In order to assure this provision for obtaining safe and reliable operation of the device, the following provisions may be applied in order to obtain the aims or objects of the invention:

the assurance that the piston shoe at all times centers itself in the respective piston-shoe seat after it has separated from the piston shoe by containing the piston shoe in the piston-shoe containment space between the actuator, rotor, and end members at the same time assuring the needed radial extension of the piston-shoe radial support member so that it remains at all times and locations between a pair of radial extensions of the rotor;

the provision of at least one-dimensional free play of the piston shoe so that the piston shoe is provided independent of the associated piston and free of it for at least one-dimensional free play, which is radial free play;

the provision of at least two-dimensional free play for the piston shoe which is free from connection to the associated piston and independently radially movable for the first dimension of free play in a radial direction and which is at least in a limited extent axially freely movable between the end members within the clearances between the ends of the piston shoes and the end members for the second dimension of free play of the piston shoe. The second dimension of free play is thereby the limited axial free play;

the provision of three dimensional free play for the piston shoe which has radial free play and the said axial free play and which has additionally the third dimension of free play which is that the piston shoe can float freely to a limited extend in the rotation direction of the rotor or contrary thereto. This direction of movement of the rotor is in this specification also called peripherally or tangentially or peripheral or tangential. This provision of the third dimension of free play is assured in that the radial support member of the piston shoe is somewhat shorter in peripheral and tangential direction than the diameter of the cylinder. Thus the radial support member of the piston shoe can freely float tangentially and peripherally between the adjacent pair of rotor radial extensions within the limit of its freedom as defined by the clearance therebetween. The floating of the radial support member between the rotor's radial extensions also makes the whole piston shoe floatable in the third dimension of free play.

The provision of one or multi-dimensional free play of the piston shoe enables rough machining tolerances of the respective parts and thereby makes the manufacturing more easy and inexpensive, while it at the same time prevents friction between closely juxtaposed moving parts, as such closeness of moving parts is not present.

Further features of the invention are:

that a plurality of cylinder groups and piston groups are provided in the same rotor of the device and the piston shoes or piston and piston shoes are at least partially radially freely movable during at least a part of the piston stroke;

that the piston shoes of a multipiston group device have at least small spaced or clearances between them and neighboring parts or members to prevent friction due to closeness between relatively moving parts or for the purpose of easy or inexpensive machining with rough machining tolerances or for the assuring of reliable operation of the device or for the prevention of sticking or breaking of parts of the device;

that radial extensions are provided in a multipiston group device on those ends of the respective piston shoes which extend toward piston shoes of the other piston group in order to prevent the escape of piston shoes of one group into the space of the other group so that the reliability of the device and of its parts is assured;

that there is provided in the radial extensions on the respective end of the piston shoes of a multipiston group device a recess or ring groove in the rotor between the neighboring cylinder groups for the temporary reception of the radial extensions of the ends of the piston shoes, the recess or ring groove serving to make possible a large piston stroke and thereby large volumetric capacity in the device;

that end members are provided on the axial ends of the piston-shoe containment space in order to prevent an overly large axial movement of the piston shoes;

that the common radius around the common mean of the bearing faces between piston and piston shoe are of a radius which is in a limited extent larger than the radius of the associated piston in order to constitute a large bearing face with a suitable medial angle of inclination relative to the axis of the respective piston;

that the piston shoe and its radual support portion are so extended or reduced that they have such radial length or extension that they cannot escape from their associated spaces but also obtain maximum strength and withstand a maximum pressure and create a maximum rate of flow so that a maximum of pressure capability and a maximum of volumetric capability and thereby a power maximum of a device of a given size or weight possible is obtained, whereby they also may obtain a maximum of efficiency of the device while remaining secure in their respective space or locations so that at all times and locations a portion of the radial support member of the piston shoe remains between adjacent radial extensions of the rotor;

that entering piston shoes are provided in the radial-piston fluid-handling device;

that deep-diving piston shoes are provided in the radial-piston fluid-handling device;

that a maximum of pressure and/or a maximum of rate of flow is obtained in the device by securing the piston shoes by portions or a portion of each of them between adjacent pairs of rotor-radial extensions; and/or, that means are provided, which appear in the drawings, in the description, specification or claims.

BRIEF DESCRIPTION OF THE DRAWINGS

FIG. 1 is a longitudinal section through an embodiment of a radial piston fluid handling device of the invention;

FIG. 2 is a cross-section through FIG. 1 along line II—II;

FIG. 3 is a cross-section through FIG. 2 along line III—III;

FIG. 4 is a cross-section through FIG. 3 along line IV—IV;

FIG. 9 is a longitudinal sectional view through an outer face of an embodiment of a piston shoe of this invention and also through its neighboring parts;

FIG. 10 is a perspective and partly sectional view into a radial fluid-handling piston device of the invention with an entering piston shoe;

FIG. 11 is a longitudinal sectional view through a portion of another fluid-handling device according to the invention;

FIG. 12 is a cross-section through FIG. 11 along line XII—XII;

FIG. 13 is a longitudinal section through the piston shoe of FIG. 11;

FIG. 14 is a view onto the piston shoes of FIG. 13 in a view from line XIV—XIV;

FIG. 15 is a view onto the piston shoe of FIG. 13 in a view from line XV—XV;

FIG. 16 is a cross section through FIG. 13 along line XVI—XVI;

FIG. 17 is a sectional view through FIG. 14 along line XVII—XVII;

FIG. 18 is a longitudinal section through another embodiment of a radial-piston fluid-handling device of the invention wherein another embodiment of a piston shoe of this invention is provided;

FIG. 19 is a section through FIG. 18 along line XIX—XIX;

FIG. 20 is a section through FIG. 18 along line XX—XX;

FIG. 21 is a section through FIG. 18 along line XXI—XXI;

FIG. 22 is a section through FIG. 19 along line XXII—XXII;

FIG. 23 is a longitudinal section through still another embodiment of a radial piston fluid handling device of this invention;

FIG. 24 is a longitudinal section through another embodiment of a piston shoe of the invention;

FIG. 25 is a section through FIG. 24 along line XXV—XXV;

FIG. 26 is a view onto FIG. 24 along arrow XXVI—XXVI;

FIG. 27 is a view onto FIG. 24 along the arrow XXVII—XXVII; and

FIG. 28 is a longitudinal section through still a further piston piston-shoe arrangement of this invention.

GENERAL DESCRIPTION OF THE PREFERRED EMBODIMENTS

Figure 5:
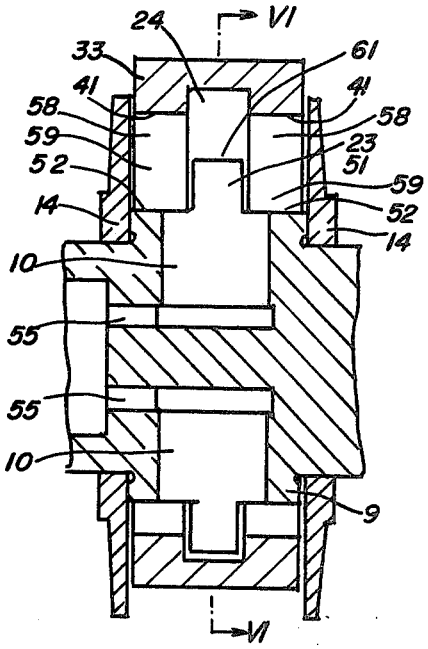
FIG. 5 is a longitudinal section through an embodiment of a radial piston device of the invention, wherein pistons and piston shoes have been eliminated in the drawing, in order to make the pistons and piston shoes more clearly visible.

The rotor 9 is rotatable in bearings 19 and provided in a housing 13 of the Figures. Rotor 9 is provided with substantially radial cylinders 10 in which pistons 2 move inwardly and outwardly for the intake and expulsion of fluid into and out of the cylinders 10. Respective passages or parts 17, 27, 29 serve the purpose of leading fluid into and out of the cylinders 10 when the radial-piston fluid-handling device of the respective drawing operates. The piston-stroke actuator means 33 has the purpose of guiding the pistons inward and outward in the respective cylinders. This inward and outward move is called the piston-stroke and the actuator means 33 is therefore the actuator or radial guide of the piston stroke. A bearing means 18 may be associated with the actuator means 33 so that the actuator 33 may revolve. If that is the case, and if the actuator 33 is a ring, then the actuator revolves around an axis, which is spaced by an eccentricity e from the axis of the rotor 9. The piston stoke thus has a length equal to 2e which means that the piston stroke is two times the eccentricity e. The actuator 33 may however also be stationary or have another form than that of a ring. If the fluid-handling device is a pump or compressor, then the rotor 9 is driven by its respective shaft, which may be revolved by a power plant. If the device is a motor, then a fluid is forced under pressure into the cylinders, the pistons being forced outward and against the eccentrically provided actuator 33, which by its inclination relative to the pistons forces the rotor 9 to revolve and give its fluid power to the shaft. The above is the generally known radial-piston fluid-handling device.

This invention deals however only with a specific kind of radial-piston fluid-handling devices. The fluid-handling devices of the invention must therefore have all the above and in addition thereto a piston shoe associated with the piston and located between the piston and the actuator. The power transfer or force transfer from a piston 2 to the actuator 33 or from the actuator 33 to the piston 2 occurs therefore in devices of the invention via the respective piston shoe or piston shoes 3. In addition the piston shoe 3 must in devices of the invention be able to enter at least into a portion of the rotor and in its most advanced form the piston-shoe can plunge deeply into a portion of the rotor, thereby characterizing itself as a "deep diving" piston shoe.

Piston shoes in a general form are already known. Those piston shoes of the prior art are however outer piston shoes or non-entering piston shoes which means that they are during the whole piston stroke outside the rotor and that they do not enter into and dive deeply into the rotor. Only in some other patents of the inventor does the piston shoe enter the rotor or dive deeply into the rotor.

The radial piston devices of the invention must therefore in addition to the above have the following:

(a) the rotor must have axially outwardly of medial radial extensions a reduced diameter, if the piston shoes are outward of the rotor, or radially bigger diameters axially beyond the radial extensions, when the piston shoes are located and moved inward of a hollow rotor;

(b) The rotor radial extensions between the reduced diameters or bigger diameters of the rotor must be smaller than the diameter of the cylinders. Thereby the radial extensions 23 of the rotor 9 are interrupted by the cylinders so that the radial extensions 23 of rotor 9 are interrupted by the cylinder 10 into rotor extension segments 23. They are called hereinafter rotor radial extensions or they are called hereafter rotor-segments. The respective cylinder portion between two neighboring segments forms then a rotor cross slot in the respective rotor radial extension 23.

(c) The piston shoe of the invention must have a medial or central piston shoe portion, also called "piston shoe central portion" (or medial portion) and the latter must be smaller than the diameter of the respective cylinder 10 and the rotor cross slot formed by it between the two neighboring rotor segments or extensions 23. The piston shoe's medial portion must have on its ends peripherally extending guide portions and they must be interrupted by recesses peripherally of the medial portion so that the guide portions can enter beyond the extreme diameter of the rotor's radial extensions into the spaced therebeyond formed by the diametrically reduced or widened rotor portions and so that the medial portion can enter the respective cylinder portion between two neighboring radial extension segments 23.

Only devices with the above means a to c are related to this invention. In the most advanced form the invention has however a further means d, (d) The actuator 33 must have a medial recess or ring groove 24 extending into the actuator 33. This groove 24 must be a little bit wider axially than the axial width of the rotor's radial extensions 23 are in order that the extensions 23 can enter into the groove 24.

The devices with the means a to c have an entering piston shoe for a large piston stroke. This large piston stroke provides a large rate of flow of the device and thereby the high volumetric capacity of the device. Those devices which have the means a to d utilize a deep-diving piston stroke. Thus an even longer piston stroke is achieved which provides the maximum of piston stroke of any kind of radial-piston fluid-handling device and thereby the fluid-handling device with the highest rate of flow and thereby with the highest volumetric capacity of all radial-piston type fluid-handling devices.

THE NOVEL SPECIFICS OF THIS INVENTION

Figure 6:
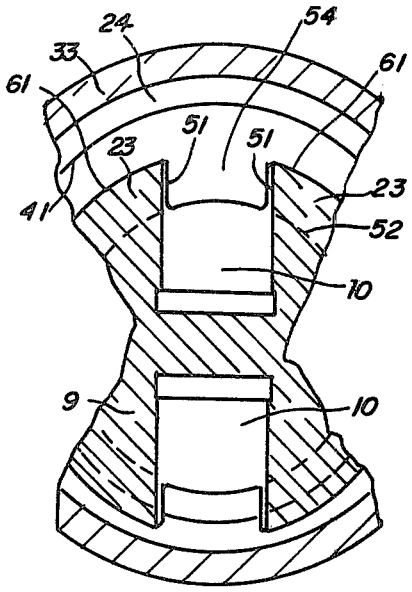
FIG. 6 is a cross-section through FIG. 5 along VI—VI.

The first provision of this invention can best be understood with reference to FIGS. 5 and 6. The device may be a pump or motor if fluid flows through its cylinders, and it may be a compressor or gas motor if gases or air flows through the cylinders. It may also be a transmission, when a fluid pump and fluid motor are coupled together by connection lines through which the fluid flows. The device of FIGS. 5 and 6 can be used for the deep-diving piston shoe. It has the rotor 9 wherein the substantially radial cylinders 10 are located. The radial extensions 23 are visible as the segments 23. Axially beyond the radial extensions 23 are the diameter reductions 52 of the rotor 9 which form the spaces 59 by the rotor reductions 52.

The rotor's outermost diameter is the diameter 61 of the outer faces of the rotor radial segments 23. The actuator 33 has the medial ring groove 24 extending into the actuator 33. Ring groove 24 is wider than the extensions 23 so that the extensions 23 can enter into the ring groove 24 as can be seen at the bottom in FIGS. 5 and 6. Rotor passages 55 serve to lead fluid into and out of the cylinders through the respective portion of rotor 9. The first provision of the invention is that a piston shoe containment space 58 is provided in the device. Piston shoe containment space 58 contains the piston shoe or the piston shoes of the device. The axial end of the containment space 58 is defined according to this invention by the end members 14. The end members 14 are either attached to the actuator 33 or to the rotor 9. In FIGS. 5 to 8 the rotor 9 has shoulders onto which the end members 14, which in this case may be rings, are attached. The end members 14 extend radially so far that they embrace at least partially the ends of the actuator means 33. If the end members 14 are attached to the actuator, then they must at least partially embrace the respective shoulders or end parts of the rotor 9. This at least partial embracing of the rotor portion or of the actuator 33 is an important provision of the invention. First, it provides an axial end to the containment space 58, thereby assuring that the piston shoes can never axially leave or escape from the containment space 58. Secondly, the embracing of the actuator 33 or of a portion of the rotor 9 assures that the two important members, the rotor 9 and the actuator 33, are radially aligned so that neither of them can axially escape from the desired position relative to the other. In earlier devices of the prior art the actuator was carried on bearings or the rotor 9. Axial fixing of actuator 33 was then effected by these bearings. That resulted in devices of the prior art often wherein rotor 9 and actuator 33 were fixed in different bearing systems which resulted in one of them being sometimes axially displaced in a certain extent. That resulted in an axial displacement of the piston shoes too and then the piston shoes scratched on the walls of the cylinders or on other places. The provision of the end members 14 as explained above prevents such scratching of piston shoes.

The piston-shoe containment space 58 of the invention is located between and bordered by the actuator means 33, the medial portion of the rotor 9 and both end members 14. The containment space 58 includes the radially inward extending space portions 59 on the ends of the radial extensions 23 and radially of the narrowed rotor diameter portions 52. Thus, if piston shoes are located in the containment space 58, they can never escape from the containment space 58. Because radially they are held in one direction by the rotor 9 and in the other by the actuator 33 and axially they are held by both end members 14.

The actuator 33 is provided with a guide face, here an inner guide face 41 for guiding of the outer faces 15 of the piston shoes 1. The rotor cross-slots 54 are clearly visible between the neighboring segments 23. The cylinders 10 form extended piston guides 51 on the respective ends of the segments 23.

After the above explanation of the piston-shoe containment space 58 and its end members 14 of the invention, the actual location and action of the piston shoes can now be explained with reference to FIGS. 7 and 8. In FIGS. 5 and 6 no pistons and no piston shoes are shown in order to illustrate the areas near the piston shoes separately, so that the piston shoe containment space 58 and its bordering members are better understood. In this respect attention is directed to the fact that the embracing of one of the members, rotor or actuator, by the end members 14 assures that the ring groove 24 and the radial extensions 23 are fixed axially relative to each other so that it is assured that the segments 23 can at all times, without actually touching the walls of the ring groove 24, enter into the ring groove 24. In prior art devices, if a groove was present the segments touched the walls of the grooves, whereby friction at a high level appeared between the segments and the walls of the grooves.

Figure 7:
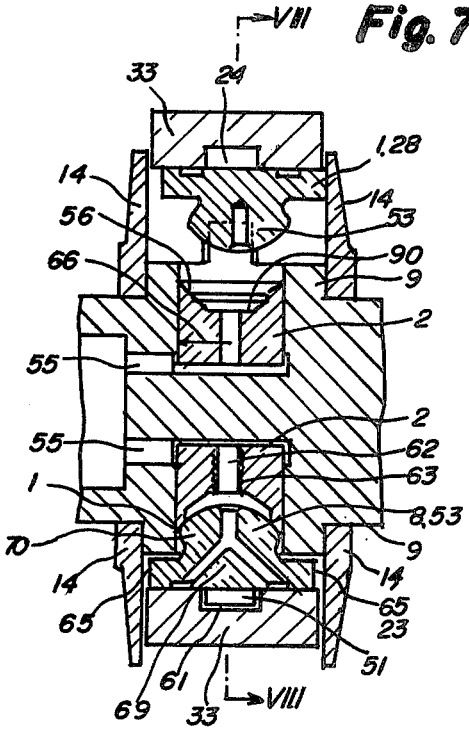
FIG. 7 is the same, as FIG. 5 but with some pistons and piston shoes inserted in certain positions.
Figure 8:
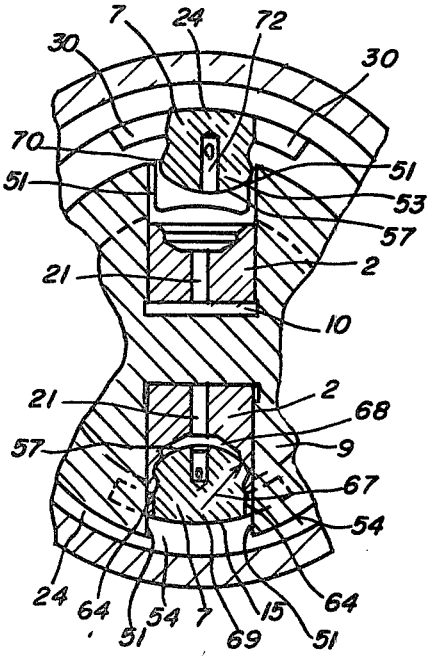
FIG. 8 is a cross-section through FIG. 7 along line VIII—VIII.

To understand FIGS. 7 and 8 better, they should be examined together with FIGS. 8 and 9. The piston shoe 1 is in FIGS. 7 and 8 demonstrated in its radial outermost position. The piston shoe outer face 15 lies thereby on the inner faces 41 of the actuator 33. The piston shoe central portion 7 has on its axial ends the peripheral extensions or guide portions 28. This is also seen in FIGS. 9 and 10. FIG. 9 shows the piston shoe on top of FIG. 8 from above and its neighboring members. FIG. 10 shows the same in a perspective view from above the side. From FIG. 8 it is visible that the piston shoe central portion 7 is narrower than the rotor cross slot 54. This is important so that the central portion 7 can enter into the slot 54. Thereby the entering of the piston shoe into the rotor 9 is assured, which makes the piston shoe "an entering piston shoe". From FIGS. 9 and 10 it will appear that the piston shoe has peripherally of the central portion 7 recesses 30, which separate the peripheral extensions or guide portions 28 of the piston shoe from each other, so that the guide portions 28 remain only on the axial ends of the piston shoe. The intersecting recesses 30 are wider than the segments 23. That is necessary so that the segments 23 can enter the intersecting recesses 30. From the piston shoes on the bottom of FIGS. 7 and 8 it is apparent that the guide portions 28 of the piston shoes enter into the radially extending spaces 59. This is also seen in FIGS. 9 and 10 where it becomes also clear that the recesses 30 are seen in FIG. 8 as empty spaces of the piston shoe on top of the Figure. The entering of the guide portions 28 of the piston shoe 1 into the radially extending spaces 59 is an important provision in order to make the piston shoe an "entering piston shoe."

On the bottom of FIGS. 7 and 8 the piston shoe 1 is deep in rotor 9. This makes the piston shoe a "deep-entering piston shoe". The central portion 7 is deep in the rotor cross slot 54 and thereby deep in the cylinder 10. The guide portions 28 are deep in the radial extending spaces 59 almost against the rotor narrowed diameter 52. The segments 23 are deep in the ring groove 24 of the actuator 33. The outer face 15 of the piston shoe has passed beyond the outer diameter 61 of the rotor deeply into the spaces 59 and 54. The central portion 7 of the piston shoe 1 is deep beyond the outer diameter 61 of the segments deeply into the cylinders 16 and deeply into the cross slot 54 between the piston guide extensions 51. The "deep diving piston shoe" is therefore defined in that the whole of the piston shoe passes beyond the outer diameter 61 of the rotor radial extensions or segments 23 into the spaces 10, 54 and 59 of the rotor 9.

The next provision of the invention is the provision of the radial support member 8 or 53 on the medial central portion 7 of the piston shoe. The radial support member 8, 53 extends from the piston shoe central portion 7 radially toward the associated piston 2. The piston 2 is located in the cylinder 10. Both, the piston 2 and the piston shoe 1 have bearing faces for the forming of the piston piston-shoe bearing means. The piston shoe has its bearing face on the radial support portion 8, 53. The bearing faces 57 of the piston shoes and 56 of the pistons (see especially FIGS. 7 and 8 at the top) are faces with radii having a common center. The radius 67 is a constant radius around the common point 69 of the piston and the piston shoes swing bearing or pivot bearing. This pivot bearing between piston 2 and piston shoe 1 is necessary in order that the piston shoe 1 can pivot or swing on the piston 2. Since during rotation of the rotor the piston shoe pivots on the piston due to the inclination resulting from the eccentricity of the actuator relative to the rotor. The expression "constant radius around a common point" means that the bearing faces 56 and 57 are either part-spherical or that they are part-cylindrical.

The radial support member 8, 53 serves to provide a maximum of radial strength and rigidity to the piston shoe. It increases the radial strength and rigidity of the piston-shoe central portion 7 and of the piston-shoe guide portions 28. It is therefore radially so wide that this maximum of strength is obtained and at all times maintained and assured.

In order to lubricate and pressure balance the bearing faces between the pistons 2 and the piston shoes 1, fluid pressure pockets 68 are provided between the pistons 2 and piston shoe radial support member 8, 53. These fluid pockets communicate via passages 21 through the pistons 2 with the fluid in the cylinders 10. Thus, the bearing portions and faces of the piston shoes are lubricated and radial fluid pressure loads are partially balanced so that the piston and piston are not too strongly pressed together and so that the piston shoes are not too strongly pressed against the actuator 33. The maximum radial dimension of the piston shoe at central portion 7 and support 8, 53 is defined in FIG. 8 by reference length 72.

A furhter important provision of the invention is that the above described common radius 67 around the common point 69 of the bearing between piston and piston shoe is at least almost as large as half of the diameter of the piston, which means at least almost as large as the radius 66 of the piston (see FIGS. 7 and 8). In the pre-preferred embodiment of the invention the radius 67 around the common point 69 is a little bit larger, about 10% to 15% larger, than the radius 66 of the piston 2. At the same time the fluid pocket 68 between piston 2 and piston shoe radial support member 8, 53 extends over more than the half the cross-sectional area of the piston 2 and almost over 60% to 80% of the cross-sectional area of the piston 2. Thereby a very high fluid pressure balance between piston 2 and piston shoe 1 is obtained. The extension of the radius 67 as described above in relation to the piston radius 66 provides in accordance with this invention pivot bearing faces 56 and 57 between piston and piston shoe of an average angle of about 45°. This gives best pivotability and also best radial bearing force to the pivot bearing. Piston shoes of the prior art which deeply enter into the piston have narrow bearing pivot faces because the piston walls make such narrowness necessary which in turn narrows the bearing area and thereby the radial pressure force bearing capacity.

During swinging or pivoting of the piston shoe 1 with its bearing face 57 on the bearing face 56 of the piston 2 during operation of the fluid handling device under pressure, the bearing faces 56 and 57 are strongly pressed together and move relative along each other. That makes a high friction loss in the device. There have been fluid pressure balancing pockets between piston and piston shoe in the past and these have reduced this friction. However, since in earlier designs the piston shoes were within bores in the pistons, the cross-sectional areas of the bearing faces between pistons and piston shoes were very small, as the designs and principles of the past did not provide space for wide fluid pressure pockets.

This present invention recongizes that the friction between piston and piston shoe during the pivoting of one of them on the other is one of the main friction losses in radial-piston fluid-handling devices. It is therefore an important provision of this invention to increase the fluid pressure pockets between pistons and piston shoes in radial fluid-handling devices to the maximum possible extent. In order to realize this provision first of all, as described above, the radius 67 around the common point 69 is made as large as possible, as otherwise the cross-sectional area of the bearing faces 56, 57 cannot become bigger than the cross-sectional area of the pistons 2. The second provision is to provide the fluid pocket 68 or 90 in the piston 2 or in the piston shoe with the biggest possible diameter in order to obtain a maximum of fluid-pressure balancing area. Thereby the bearing area 56, 57 of the bearing faces 56, 57 of the pistons 2 and piston shoes 1 becomes smaller than the fluid pressure pocket cross-sectional area. This making of the cross-sectional are of the fluid pressure pocket 68 bigger than the cross-sectional area of the bearing faces 56 and 57 assures that at least the cross-sectional area of the fluid pocket 68, 90 reduces the bearing load on the bearing faces 56, 57 by its fluid pressure action between the piston and the piston shoe. The cross-sectional area of the bearing faces 56, 57 may or may not serve for the reduction of the load between the piston and piston shoe. Since these faces 56 and 57 are pressed together by the force of fluid in the cylinders 10, it is not sure at all times whether or not fluid under pressure is present in the bearing area between the bearing faces 56 and 57. Some times when the pressure forces are small fluid may enter into the bearing between them and at other times when a strong fluid pressure acts over a long time in the cylinders 10 all fluid may be forced out of the bearing between the bearing faces 56 and 57. Consequently, it is never sure, as this invention discovers if there is fluid under pressure between the bearing faces 56 and 57, or if there is no pressure fluid between the bearing faces 56 and 57, or if there is fluid under pressure only in a portion of the bearing area between the bearing faces 56 and 57. Therefore, it is important in accordance with this provision of this invention, not to rely on the fluid pressure balancing effect of the area between the bearing faces 56 and 57 too much, but to rely mainly on the wide extension of the fluid pocket 68, 90 between piston and piston shoe. Consequently, it is the provision of this invention to make the diameter of the fluid pressure pocket 68, 90 as big as possible.

This cited provision has still a further reason. According to this invention the piston may be unconnected to the respective piston shoe, so that the piston shoe can radially move away from the respective piston. When however pressure appears again in the cylinder 10, the piston 2 is moved again toward the respective piston shoe 2. Thereby the piston 2 and piston shoe radial extension 8, 53 are pressed together. At this moment of renewed contact of the piston 2 and piston shoe 1 fluid is present between the bearing faces 56 and 57. However, during the reentering into contact the fluid is pressed out of the space between the bearing faces 56 and 57, until finally the faces fit together again with only a thin or no fluid film between them. According to one discovery of this invention, the time to press the fluid away from the area between the bearing faces 56 and 57 depends in addition to other factors largely on how long the bearing faces 56 and 57 are. As the radial extension of the bearing faces 56, 57 increases more time is needed to press the fluid between them away. On the other extreme, if the radial extension of the bearing faces 56, 57 is very short, the time for pressing the fluid between them away is very short. If the radial length of the bearing faces 56, 57 is zero, then the time for pressing the fluid between them away would be zero too. The long time for pressing the fluid away from the space between radially wide bearing faces 56, 57 results, according to this invention, in that during this long time of closing the faces 56, 57 together, a flow of fluid under pressure escapes from cylinder 10 through piston passage 21 and through the then still opened space between the faces 56 and 57 out of the cylinders 10 into the open housing in the pump. This flow of escaping fluid is a leakage flow, which narrows the volumetric efficiency of the device considerably. This disastrous flow of leakage is according to this invention reduced by reducing the radial size or extension of the bearing faces 56 and/or 57. Because the shortening of the bearing area between faces 56 and 57 shortens the closing time loss at the closing of the bearing faces between piston and piston shoe. It is thereby a discovery of this invention, that the described leakage flow is a closing time loss between the piston and piston shoe during the time, when they move together or toward each other for attaching themselves together. It is also a discovery of this invention, that this closing time loss and thereby leakage loss is smaller when the length of the radial size of the bearing face connection between faces 56 and 57 is shortened. Consequently, it is an important feature of this invention, to make the radial extension of the bearing face 56 and/or 57 shorter than the radial extension of the fluid pocket 68 or 90.

A still further means to reduce or prevent the discovered leakage flow of this invention is illustrated in the piston of FIG. 7. The piston 2 of FIG. 7 has a fluid flow through or rate of flow reduction means 62 and/or 63. In FIG. 7 the flow-reduction device consists of a bolt 62 which is inserted into the piston 2 and has threads 63 which form a spiral around the bolt 62. Thus a long channel of small cross-sectional area is formed around the bolt 62 between this bolt 62 and the piston 2. The length and narrowness of the channel 62 prevent any big flow of fluid through the piston 2. It reduces the maximum of rate of flow through piston 2 to a minor fraction of the rate of flow through the cylinders 10 of the fluid handling device. Consequently, according to this invention, the cross-sectional area of the channel or passage 63 is so small and the length of passage 63 is so long that only so much fluid flows through the piston 2 as is needed to fill the fluid-pressure pockets and channels or passages 21 in the piston and piston shoe. There then remains no fluid to escape under pressure from the pocket 68, 90 through the faces 56, 57 out of the pressure zone of the device and the bearing faces 56, 57 are close against each other immediately or rapidly. The provision of a narrow passage 63 in the piston 2 is therefore an important provision of this invention to narrow or prevent the closing time loss and the leakage loss during the closing of the piston and piston shoe at its bearing faces 56 and 57. The passage 63 need not be a thread of a screw; it can also be any other form of narrow passage. In a superior arrangement it is a flow-restricting one-way valve. The latter is however not shown in the drawing as flow-restricting one-way valves are generally known and do not need any specific description on this specification.

Having thus described the discovery of the closing time and leakage flow loss of unconnected pistons and piston shoes and the narrowing of them or the prevention of them, we can now discuss and understand one of the main provisions of this invention. This is the disconnection of the piston and piston shoe and the free floating of the shoe in the device.

I obtain a first type of free play or free floating of the piston shoe of this invention, which is radial free play or the radial free float of the piston shoe 1 of this invention. In the bottom of FIGS. 7 and 8 the pistons 2 and piston shoes 1 are pressed together so that the faces 57 bear upon the faces 56. In this position piston 2 and piston shoes 1 fit against each other. In the upper portion of FIGS. 7 and 8, however, the pistons 2 are drawn in a deep position in the cylinders 10, while the piston shoes 1 are illustrated in the radial outermost position and freely floated away from the pistons 2. The piston shoes 1 can then radially freely move or float within the piston shoe containment spaces 58 of the invention. They can freely float radially between the piston 2 and the actuator 33. This is the provision of the first free play of the piston shoe of the invention, radial free play.

It is however preferred in accordance with this invention to make the axial length of the piston shoe 1 a little bit shorter than the axial distance between the end members 14 of the device. In other words, to make the piston shoes 1 is a little bit shorter than the axial length of the containment space 58. Thereby a little clearance appears between the ends of the piston shoes and the end members 14. This assures that the ends of the piston shoes do not frictionally engage the end members 14. This reduces friction in the device and improves the mechanical efficiency of the device. Such shortness of the axial length of the piston shoe compared to that of the containment space 58 of the invention constitutes the second free play of this invention, which is axial free play or free movablility of the piston shoe of this invention. FIG. 7 at the top illustrates how the piston shoe in its extreme case can axially float to one of the axial ends of the containment space 58 so that a big gap appears between the other end member 14 and the piston shoe. When thereafter the piston and piston shoe move against each other again, the piston shoe centers itself in the bearing face 56 of the invention.

A further provision of this invention is the third type of free play or free float of the piston shoe 1. This third free play of the piston shoe is the tangential or peripheral free play or free floating of the piston shoe. This third free play of the piston shoe of this invention is explained by the position of the piston shoe at the top of FIG. 8. The provision of the third free float or free play of the piston shoe of the invention is due to the fact that the diameter of the radial support member 8, 53 of the piston shoe 1 is a little bit smaller than the diameter of the cylinder 10. Thus the support member 8, 53 of the piston shoe 1 can move within the cylinder 10 or between the piston guide extensions 51 a little bit forward or backward relative to the rotary movement of the cylinder 10. This is the peripheral or tangential free movability of the piston shoe, or its third free play.

To demonstrate this third free float or free play of the piston shoe of the invention, the piston shoe in FIG. 8 top is shown positioned against the right guide faces 51, while a bigger gap is seen on the left between member 53 and the left piston guide 51. The piston shoe could however also float in the contrary direction against the left guide face 51.

Since the bearing face 56 is inclined toward the piston shoe to form a concave part-spherical seat and the face 57 is inclined toward the piston 2 to form a part-spherical surface, both seats are self-centering during operation of the device the piston is moved against the piston shoe or when the piston shoe is moved against the piston. Thus, the invention provides a self-assembling piston piston-shoe arrangement and this self assembly of the piston and piston shoe can take the place of the heretofore utilized connection between the piston and piston shoe. In order to make this self assembly of the piston and piston shoe of the invention effective in operation in a fluid handling device, the closing time loss and occurring leakage flow, which was described above must be kept at a minimum or prevented.

The provision of the non-connected piston piston-shoe assembly of the invention cuts manufacturing time and costs, makes the piston and piston shoes simple in design and manufacture and at the same time gives maximum radial strength to the piston shoe and at the same time makes the highest cross-sectional area of the fluid pocket 68, 90 possible. Thereby the radial strength and operability at highest fluid pressure of the piston and piston shoe is achieved. At the same time the highest possible rate of flow through the device is achieved, because a fully and deeply diving piston shoe is provided, which provides the highest possible piston stroke and rate of flow in the device.

Having described the possible three free plays or free floats of the piston shoe, which may also be called three-dimensional free play or three-dimensional free float of the piston shoe of the invention, I shall now describe how this three-dimensional free play is possible without accidents. The actuator 33 prevents any escape of the piston shoe out of the containment space 58 in one radial direction. The rotor 9 prevents any escape of the piston shoe out of the containment space 58 in the other radial direction. The at least partial embracing of the ends of the piston shoes by the end members 14 prevents any axial escape of the piston shoe out of containment space 58 and the engagement of at least a portion of the radial support member 8, 53 within the cylinder 10 or between two neighboring piston guide faces 51 prevents any peripheral or tangential escape of the piston shoe out of its associated space. In order to assure this the radial extension 72 of the piston shoe central portion 7 together with its radial support member 8, 53 is so long, that at least a portion of the radial extension 8, 53 remains at all times within the associated cylinder 10 or within the space or cross-slot 54 between two adjacent piston guide extension faces 51.

This can be mathematically expressed, as follows:

In an entering piston shoe the radial length 72 of the piston shoe must be a little bit longer than the piston stroke 2e.

and;

In a deep-diving piston shoe the radial length 72 of the piston shoe must be a little bit longer than the piston stroke minus the size of the entering of the rotor segment 23 into the groove 24 of the actuator 33.

If these mathematical rules are observed the piston shoe can be utilized with the three-dimensional free play of this invention. If these rules are not obeyed the piston shoe 1 might escape from the slot 54 and thereby damage the device.

From the above rule it could be assumed that it would be best for the piston shoe radial extension 8, 53 to project deeply into the piston 2. This has been thought of and tried by the inventor. Thereby it was discovered however in accordance with this invention that a deeply hollow piston has very little weight. The centrifugal forces acting on the lighter piston are then so small that the piston moves slower than a heavier piston shoe does. That increases the closing time when the piston and piston shoe move together again, when the fluid force in the cylinder 10 presses them toward each other again. This longer closing time makes the above discussed closing time and leakage loss bigger. Therefore it is better, in accordance with this invention, to obey the above rule for length of the piston shoe extension 72, but also to restrict it to the minimum length of the above rule. Furthermore, the deep entering of the position shoe into the hollow piston would provide a piston wall which would reduce the cross-sectional area of the bearing 56, 57 in the above described undesired manner of the prior art. Thereby the radial bearing capability and the pressure capability of the device would be reduced.

In accordance with this invention a still further lack of high power of the device caused by deep projection of the piston shoe into the piston is discovered. That is that the piston shoes swing in the cylinders 10 and slots 54 more when the piston enters more deeply into the piston shoe. That results in moving of the central portion 7 against the respective piston guide extension 51. In order to prevent this the piston-shoe central portion 7 would be very small in such piston shoes which enter deeply into the pistons. That reduces the strength of the piston shoes considerably and thereby the radial pressure capability of the piston shoes. It is therefore proposed by this invention to stick to the rule of the radial length 72 of this invention and, in order to make a piston shoe of maximum of strength, to make the radial support 8, 53 of a diameter as big as possible and the innermost part of the central portion 7 of the piston shoe as wide as possible peripherally and to provide the inclined or narrowing faces 64 on the piston shoe central portion 7 so that the piston shoe can swing in the slot 54 and so that the central portion 7 does not touch the piston guide face extensions 51. This provision of the invention is shown on the piston shoe in the bottom portion of FIG. 8.

Maximum strength of the piston shoe is demonstrated in FIGS. 7 and 8. They show that the central portion 7 together with the radial support 8, 53 form almost a big bar of a cross-section of equal sides. FIG. 7 shows, that the fluid pockets 16 are aligned almost radially of the wide radial support member 8, 53 so that the piston shoes in this view form also almost a block of equal sides. Thus we have practically a cube of equal sides which has maximum strength. The guide portions 28 are only for providing a stable guide of the piston shoe. The are not adapted to withstand maximal pressure forces as the main forces which act against the piston shoe act only in the fluid pressure pockets 68, 90 and 21.

Thus, the deep-diving or entering piston shoe of the invention is practically as strong as a cube of material but it is an entering or deep-diving piston shoe which provides the maximum possible piston stroke and thereby rate of flow through the device. Consequently the piston shoe of the invention is not only one of the simplest but also the piston shoe for the highest power of the device. High power is obtained by the longest possible piston stroke and thereby highest rate of flow and at the same time in combination with the highest strength and pressure capability.

The device of FIGS. 1 to 4 show the most of the above described features of FIGS. 5 to 8. These features and members of FIGS. 1 to 4 are therefore not repeated again. However, FIGS. 1 and 2 show a complete device for the handling of fluid as a pump, compressor or motor. Bearings 19 are provided in housing 13 for rotatably supporting the rotor 9. Bearings 18 are also provided in housing 13 to enable the actuator 33 to revolve. Passages 29 conduit fluid into and out of the rotor cylinders 10. The device has fluid ports 17 and 27. Plate 139 may be inserted between the thrust member 129 which may press against the plate 139 and thereby against the rotor for sealing the flow of fluid into and out of the rotor 9. Front bearing 229 may bear the rotor 9 on the other end and passage 239 may pass fluids to the front bearing 229. FIGS. 3 and 4 demonstrate, that intersecting recesses or guide area restriction recesses 22 may be provided in the guide portions 28 of the piston shoes. Their purpose is mainly to restrict the area around the fluid pockets 16 so that an excessively high fluid force cannot develop outside the outer face 15 of the piston shoe, as they could, if too high, force the piston shoe 1 away from the actuator 33 which would cause undesired leakage in the device. FIG. 3 shows also how the intersecting recesses 30 between the end guide portions 28 divide the guide means into two or four end portions 29 and how the intersecting recesses 30 are peripherally or tangentially extended from the central member 7 of the piston shoe.

In the upper portions of FIGS. 7 and 8 the pistons are shown in an innermost position but the piston shoes in an outermost position. It should be understood that that is done in order to understand the non-connected piston and piston shoe better. Actually in operation such innermost position of the piston would only appear if the piston sticks in the cylinder; but in smooth operation the pistons and piston shoes are never radially so far apart from each other as demonstrated in FIGS. 7 and 8. Actually they remain closer together, about as illustrated in FIGS. 1 and 2.

In FIGS. 11 and 12 a radial piston device with a plurality of cylinder groups 10 and 110 is partially shown. A deep ring groove or radially entering groove 78 is provided in accordance with this invention in rotor 9 between the two adjacent cylinder groups 10 and 110. Into this groove 78 a ring 77 is provided. This ring 77 has at least the same radial extension as the piston shoes must have by reference 72 in accordance with the rules of this invention. The ring 77 enters deeply into the groove 78 at the respective location and prevents escape of the piston shoes of one group into the space 58 of the other group. Thus, the ring 77 has the same function as an end member 14. However, it need not be fixed to the rotor or actuator but can freely float in the double containment space 58. The piston shoes 101 of the other group and the cylinders 110 of the other group may be angularly spaced between the piston shoes 1 and the cylinders 10 of the first group. The piston shoe central portions 7 may again have the inclined faces 64 of the invention. (See FIG. 12). The further specifics of the invention are already understood from the description of the other Figures.

The device of FIGS. 11 and 12 can however employ another embodiment of the piston shoe of the invention. This embodiment of the other piston shoe differs in that one end of the piston shoe has at least one radial extension 75 which can enter into the ring groove 78 of the rotor 9. The piston shoe may thereby have a partially radially extended end face 74. This may be adjacent the respective piston shoe or piston shoes of the other piston groove. The radially extended end face 74 prevents the piston shoe of one of the piston groups from entering into the containment space of the other piston shoe group as, when a piston shoe of one of the piston shoe groups tries to escape axially from its associated containment space 58 into that of the other piston shoe group it will at all times run against a radially extended end face 74 of the piston shoe of the other group and which will prevent the escape of piston shoes of one or the other group out of the respective piston shoe containment space 58. Thus, the radially extending end face 74 or the radial extension 75 of the piston shoes prevent axial escape of the piston shoes out of their associated spaces in accordance with this invention.

The piston shoe of this invention as described in the above paragraph is separately shown in FIGS. 13 to 17. Piston shoe 1, 101 has the central portion 60 from which the radial support portion 53 extends radially. Radial extension 53 has the bearing face 57. The intersecting recesses 30 separate the end-guide portions 28 from each other, as on the other piston shoes of this invention. Passage 21, recesses 22, pockets 16 have the same structure and function as on the other piston shoes of the invention. The specific features of this embodiment of a piston shoe of the invention is that on at least one axial end of the piston shoe at least one radial extension 75 is provided and/or that an end face 74 or end faces 74 is or are provided. The purpose of members 74 and/or 75 is already described above. For easy manufacturing of the piston shoe of this embodiment, the end-radial extension 75 may be interrupted by intersecting recess 76.

The radial extensions 75 are on the peripheral end halfs of the guide portions 28. This feature makes it possible to press, forge, cast, or stamp the piston shoes as through the intersecting recess 76 a portion of the forming die can extend to the respective half of the radial support member 53. And the other half of the forming die can be extended against the other half of the radial support portion 53 and toward the end thereof beyond the radial support portion and against the innermost ends of the radial extensions 75. The only machining then remaining is the accurate cutting or grinding of the seat face or bearing face 57 of the radial support member and of the outer face 15 of the piston shoe and the machining of the passages and pockets 21 and 16. It is also convenient to set a number of piston shoes together as a ring. That makes the machining of the outer face 15 and of the pockets 16 by automatic machines easy and inexpensive. Also those rings of a plurality of piston shoes can be forged, pressed, stamped, or casted. The intersecting recesses 76 and 30 can thereby be also stamped, casted, forged, or pressed. The recesses 76 therefore make possible an easy and inexpensive manufacturing of the piston shoe of this embodiment of the invention without reducing its strength or functional application.

FIGS. 18 to 20 demonstrate an embodiment of a piston-shoe of the invention which is pivotally connected to the piston assembled into its neighboring parts of the fluid handling device of this embodiment of the invention. FIG. 21 is a cross-sectional view through a separately shown part-cylindrical bearing member of the piston shoe of the FIGS. 18 to 20 and FIG. 22 shows the piston shoe of FIGS. 18 to 21 from below.

The piston shoe is again provided within the piston shoe containment space 58. The end members 14 are again provided as in the earlier discussed Figures for preventing axial escape of the piston shoe. The piston-shoe radial support member 88 is formed as a part-cylindrical portion with an axis normal to the axis of the piston 2. The piston 2 embraces this part-cylindrical portion or radial support member 88 partially by the radially outermost portions of the piston. The piston 2 has a hollow part-cylindrical transverse bore in which the part-cylindrical radial support member 88 is pivoted and embraced. The cross bore in the piston is radially partially open so that the neck between the member 88 and central portion 7 of the piston shoe can extend therethrough. This arrangement is partially already known from earlier patents of the inventor. However, the known part-cylindrical portion and connected piston and piston shoe have certain limitations which prevent the maximum of pressure capability and the maximum of rate of flow.

The following errors were found:

(a) the part cylindrical support portion or pivot portion 88 had planar end faces. These scratched during pivoting with their corners along the inner walls of the cylinders and over a long time damaged the inner faces of the cylinders. In devices of low pressure the scratching was only little, so that years were needed until this error could be discovered and be overcome by this present invention;

(b) the medial central portions 7 of the known piston shoes had to be narrow in order not to touch the neighboring piston guide faces 51 or the stroke of the device had to be so short that running of the central portion 7 against a neighboring guide face 51 did not occur. This resulted either in a short piston stroke and thereby in a restricted flow through or rate of flow through the device or it resulted in a weak piston shoe central portion which could not bear the high pressure because it was too narrow;

(c) the connection member 88 was too far from the central portion 7, which resulted in too big an inclination of the central portion 7 which in turn again needed to be narrowed in order to prevent touching of the central portion 7 against the neighboring guide face 51 in a long piston stroke;

(d) or the piston shoe central portion inner face struck against the flat top of the piston when the piston stroke became long. The latter decreased the piston stroke of the device and thereby prevented again the maximum of rate of flow of the device.

All four of the above prevented a maximum of pressure and/or rate of flow through the device and thereby limited the power of the device.

By the provisions of this embodiment of a piston shoe pivotal on the piston the errors described above have been completely overcome.

Accordingly the first feature of this invention with pivotally connected entering or deep diving piston shoe is the provision of part-cylindrical ends 86 on the swing member 88 of the piston shoes. These part-cylindrical end faces 86 of the radial support member 88 have a radius 87 (see FIG. 21), which is a little bit shorter than the radius 66 of the piston 2. Thereby a small space 83 appears on each end of the radial support portion 88. The radial support portion 88 has now two radii of part-cylindrical portions the radius 89 around the common middle or center line 96 and which substantially corresponds to the substantially equal radius of the part-cylindrical bearing portion in the piston 2, and the radius 87 of the end face 86 around the vertical middle center line of the member 88. By the provision of the part-cylindrical end 86 of the invention of the swing member 88 the bearing area of the bearing faces of radius 89 are increased between the piston 2 and the piston shoe member 88 so that the radial bearing capability of the piston shoe of this invention is increased. Consequently the piston shoe configuration of the invention can bear higher pressures in fluid in the device and thereby increase the power of the device.

The next feature in this embodiment of a pitovally connected piston piston-shoe assembly of the invention is the provision of inclined faces 82 on the outer portions of the pistons 2. Thus the center line 96 of the swing member 88 can be moved nearer the outer face 15 of the piston shoe to reduce the tangential swing-out of the piston shoe central portion 7. Consequently the piston shoes central portion 7 can be made wider or bigger in tangential or peripheral direction. This increases the strength of the central portion 7 and thereby the strength of the piston shoe. Consequently the piston shoe is able to bear higher fluid pressure so that the power of the device increases. Running of the inner face of the central portion 7 against the outer edge of the piston 2 is prevented by the inclination 82 of the top of the piston of this invention.

The next feature of this invention is the provision of inclined faces 64 on the central portion of the piston shoe. The inclination 64 on the central portion 7 of the piston shoe makes it possible to widen the central portion 7 on its side and toward the piston so that the strength of the piston shoe central portion 7 and thereby of the piston shoe is increased. That again increases the pressure capability and the power of the device. The inclination 64 of this invention is of such size that the piston-shoe central portion 7 with the longest possible piston stroke can just swing between the piston guide faces 51 without touching them or scratching on them.

There was a further problem with the known devices:

(e) the balancing recess between the piston and piston shoe was only a small rectangle because it was assumed that a wide face or faces 94 between the piston and piston shoe swing member was needed.

This assumption and provision was an error which resulted in high mechanical friction losses in the devices.

This mechanical friction loss was never found before this invention because the location of the fluid pocket of the swing member 88 was never deeply studied and the friction could never be separately measured. In accordance with this invention it has now been found that the radial forces in the fluid in the cylinders 10 press the piston 2 tightly against the piston-shoe radial support member 88. That results in the clearance between the mutually engaging faces of radius 89 around the common middle or center line 96 of the piston piston-shoe pivot connection becoming after a little time of such acting of fluid pressure in cylinder 10. The consequence thereof, according to this invention, is that the faces with radius 89, the bearing faces 94, run dry during the pivoting of the piston shoe in the piston. Thus the coefficient of friction between the bearing faces of the swing bearings 94 increases roughly ten times, namely from roughly 0.02 to 0.2. The invention reduces this friction between the piston and the piston shoe roughly ten times by reducing the length of the bearing face 94 of the swing member 88 of the piston shoe to a minimum so that at all times at least a small fluid film remains between the bearing faces of piston and piston shoe. The fluid pocket 91 may either be provided in the piston 2 or in the piston-shoes swing member 88. The shortening of the bearing faces 94 of this invention results at the some time in a substantial widening of the fluid pressure pocket 91 between the piston and piston shoe. This widening means practically a doubling of the cross-sectional area of the fluid pressure pocket 91 between the piston and piston shoe. This again results in a reduction of the pressing force between piston and piston shoe to substantially more than half of the earlier force of earlier devices. Thus the provision of the means of this invention reduces the friction between the piston shoe and the piston roughly to a twentieth of the friction in earlier devices. The provision consists according to this invention in the narrowing or shortening of the bearing faces 94 and in the widening of the cross-sectional area of the fluid pocket 91 between piston and piston shoe. The fluid pressure pocket 91 is thereby substantially changed from a rectangular one to a cylindrical one as can be seen from FIG. 22. The fluid pressure pocket 91 is at least part-cylindrical. It can however be also fully cylindrically, especially if applied in the piston. The former rectangular pocket could be provided only in the piston shoe but not in the piston for machining reasons. The cylindrical pocket 91 of the invention can easily be provided in the piston also. If the part-cylindrical fluid-pressure pocket 91 is provided in the piston-shoe swing member 88 as shown in the drawings then it is required or preferred to provide the inclination 90 of the invention on the ends of the pocket 91 in order to obtain axial strength in the bearing portions 95 which bear the bearing faces 94.

The inclinations 90 on the bearing portions 95 of the swing member 88, which make the bearing portions narrower at their ends toward the pistons, but wider as they near the center line 96 of the swing member 88, are therefore an important provision of this invention in order to achieve maximum size for the fluid pocket 91 and swing member 88 of highest radial and axial strength for a maximum of pressure in fluid in the device. It is thereby possible to make the bearing faces 94 so short that even when completely pressed together a small fluid film remains between the bearing faces of the piston piston-shoe connection. Fluid enters even the most closely adapting faces at least one or two millimeter so that a length of 1 mm to 3 mm or more is suitable and best for the extension of the bearing faces 94. Such shortness is possible only if the inclinations are provided as described above with reference to inclinations 90.

In accordance with this invention it has further been found that not only the peripheral ends of the flat ends of the swing members of the past scratched along the cylinder walls and damaged them in time but also that the end turned toward the piston of the end faces of the swing members of the past scratched at certain times along the walls of the cylinders 10. This happened when the swing members 88 pivoted to its most pivoted position. The inner portion of the end face closest to the piston pivoted then away from its radial innermost position towards an inclined position relative to the axis of the cylinder. There however the length of the swing member bed was shorter than at its bottom because the piston is round. The innermost portion of the swing member end face then scratched there along the wall of the cylinder and damaged it in time. It is therefore an important discovery of this invention that the innermost portion of the flat end face of the swing member 88 of the past was a further error which resulted in the breaking-down of the fluid handling devices with time. The invention overcomes this error by providing inclinations 85 on the innermost portion of the end faces of the swing member 88 of the piston piston-shoe connection. These inclinations extend from the most radial inward position a little bit into the neighborhood thereof and thereby the problems of the devices of the past are avoided by the provision of the inclinations 85 on the end faces of the swing members 88 of the piston piston-shoe connection.

A still further discovery of this invention is that in earlier related devices the actuator means 33 was supported at its ends in separate roller bearings. These fixed the axial position of the actuator 33. On the other hand the rotor 9 was supported in other bearings. The bearing of the actuator 33 and the rotor 9 in different bearing systems for axial fixing of them resulted naturally in axial displacement or dislocation of the rotor or of the the actuator relative to one another. This is due to the tolerances of machining in the axial retainers which the different bearings needed for their axial fixing. Due to such axial dislocation, even if it was small, the swing member 88 became also dislocated to a small extent. This small dislocation resulted however in one end of the swing member stratching on the neighboring portion of the wall of the cylinder 10. The other end of the swing member 88 was then spaced from the cylinder wall. This resulted again in mechanical losses due to friction on the scratching end face of the swing member 88 and it resulted also in damage to the respective portion of the cylinder wall in time.

This disastrous error of the devices of the past is overcome by this invention in that the end members 14 are fixed at equal distances from the middle of the rotor and actuator. The end members 14 embrace at least partially the actuator 33 or the rotor 9 and are fitted to the rotor 9 or the actuator 33. Thus this embracing keeps the other of the two members 9 and 33 in definitely fixed axial alignment so that they are both exactly radially above or beneath each other. The piston shoes are then made so short, in accordance with this invention, that a small space 84 remain on each end of the respective piston shoe between the piston shoe and the neighboring end member 14. The swing member is then in accordance with this invention provided with such a radius 87 that slightly wider spaces 86 remain on each end of the swing member 88 between the respective end of the swing member 88 and the neighboring portion of the wall of the cylinder 10. Thus the scratching of an end face of the swing member 88 of the invention is prevented entirely by the above described means. This prevention of axial dislocation of the swing member 88 also prevents friction between a swing member and a cylinder wall portion and thereby increases the mechanical efficiency of the device over that of former related technology. At the same time it assures in accordance with this invention a long service life of the cylinder walls of cylinders 10 and of the end faces of the swing members 88 of the piston piston-shoe connection.

FIG. 23 shows a portion of a multi-cylinder group fluid handling device in longitudinal sectional view with a number of different piston piston-shoe assemblies of the invention assembled therein. FIGS. 24 to 26 show one piston shoe of this invention separately and FIG. 28 is a sectional view through another embodiment of a piston piston-shoe assembly of the invention.

The two medial cylinder groups 10 have a common actuator 33. The medial actuator 3 is kept in its axial position by the end-radial extensions 75 and/or 96 of the piston shoes of the respective adjacent outer cylinder groups 10. The fixing of the axial position of the medial actuator 33 is a provision of this invention. It eliminates the need for end members or rings between the medial and the outer cylinder groups and thereby reduces the axial length of multiple cylinder group devices and makes them thereby more inexpensive.

The next feature of this embodiment is the provision of radial extensions 105 and/or 97 also on the other ends of the piston shoes. This makes it possible for the outer end members 14 to keep the outer piston shoes in axial position and the outer piston shoes to keep the medial actuator and the medial piston shoes in axial position. Attention is directed to radial extensions 75 and 96 which not only embrace at least partially the medial actuator 33, but also at least partially embrace the medial piston shoes. On the other ends the end members 14 embrace at least partially the outer piston group piston shoes. Thus all its piston shoes including the medial actuator 33 and the both outer actuators 33 of an at least four-cylinder group device control their axial positions relative to each other between only two outer end members 14.

Piston shoe 1 of the left cylinder group has at one end a plurality of radial extensions 75 as shown in FIGS. 13 to 17 with an intersecting space 76 therebetween. The feature of this piston shoe in accordance with this invention is that it has also a further radial extension 105 on its other end. The latter is a further provision of this invention and serves the purpose of engaging the adjacent end member 14.

The next feature of the invention is the provision of a tight seal between the respective piston 2 and the wall of the respective cylinder 10. This is demonstrated by the piston in the left cylinder group. The piston 2 has a narrow end portion 126. A plastic seal 125, for example an o-ring, is provided therein surrounded by a piston ring 107. This piston ring has a narrow portion on the end toward the piston which forms a space 99 that communicates with a space under less pressure, e.g., the housing via passage 106 at radial outermost position of piston 2.

Thus space 99 becomes a space of lesser fluid pressure than the space 126 between its piston and the piston ring 107, because space 126 communicates via passage 127 with the high pressure space of the respective cylinder 10. The consequence thereof is that the ring 107 is adapted to withstand larger a pressure area of high pressure from radially inside than from radially outside. This deforms the ring means 126 radially outwardly and presses it tightly against the wall of cylinder 10 and thereby seals the cylinder 10. Ring means 126 is of such radial thinness that it can deform under such a fluid pressure difference from its radial inside and outside to such extent that the sealing along the wall of the cylinder 10 is achieved with very little friction. For the latter purpose of less friction the ring 107 is axially as short as possible. Plastic seal or O-ring 125 serves to prevent the escape of fluid between the piston and the ring 107. The described function of seal with little friction depends highly on the thickness of the ring 107, its axial length, and on the axial length and radial depth of the recess 99. If these measures are suitably taken and the material of the members and their surrounding parts is sufficient, then the seals of this embodiment of the invention act almost perfectly and with the desired low friction. The seal members 125 and 107 may be held on the piston 2 by the retainer means 123 which in turn may be fastened in the piston 2, for example by extensions in the pocket on the other end of the piston or in the bore of the piston.

The next feature of the invention is the fastening of a piston shoe on the piston as shown in the left cylinder group of the medial cylinder groups. The feature is a retainer 109 between piston 2 and piston shoe 1. Piston shoe 1 may have therefore a space 108 for the reception and retaining of the retainer 109. Retainer 109 may extend through portions of piston shoe 1 and piston 2 and it may be retained in piston 2 for example by retainer means 113, 115, 129 or one or more of them. One or more of them may be flexible. A close fit may exist between the retainer member 109 and the piston shoe 1 in order to prevent fluid leaking out of the pocket 68 between piston and piston shoe, a seal there may serve this purpose. Passages 21 may be separate from space 108 and they may be parallel to the axis of the piston. The retainer members are by way of example only. Any other suitable design will fit the purpose if care is taken that the piston shoe can pivot on the piston. In the Figures the clearances serve for this purpose.

The piston shoe in the outermost right cylinder group corresponds mainly to the piston shoe of FIGS. 18 to 22, but has in accordance with this invention at least one radial extension on at least one axial end of the piston shoe. In the figures it has three radial extensions, two radial extensions 96 on one axial end with an intersecting space 76 therebetween and a further radial extension 97 on the other end of the piston shoe. These are the preferred locations of the radial extensions of this piston shoe by manufacturing reasons. To understand their locations better, the piston shoe is shown in separate FIGS. 24 to 27 in different sections and views. These Figures show the radial extensions 96 with the intermediate intersecting space 76 on one end of the piston shoe and the radial extension 97 on the other end of the piston shoe. The location of the extensions 96 is preferred for pressing, forging, or other reasons as explained with reference to FIGS. 13 to 17. The radial extension 97 on the other end may be in the middle of the end of the piston shoe so that it can be formed by forging, pressing, casting, or the like together with swing member 88. An intersecting space 197 should then be provided or machined between the respective adjacent end of the swing member 88 and the radial extension 97 in order that the piston shoe can be an entering or a deep-diving piston shoe in accordance with this invention. The other references of FIGS. 24 to 27 are already understood from the descriptions of other Figures where they have the same reference numerals.

The embodiment of a piston piston-shoe assembly of the invention, which is shown in longitudinal sectional view in FIG. 28, combines the embodiments of the left and second second left assemblies of FIG. 23. Fluid pockets 16 communicate via separate passages 21 with fluid pocket 68. Ring means 107 is retained on the piston by retainers 114 and 116. Retainer 116 is on the other end retained by portion 129 in fluid pocket 68. A medial space in the piston 2 is wide enough to contain the pivotal retainer 115 and still leave enough space for communication of pocket 68 through piston 2 with cylinder 10. Retainer 115 has a head 109 for the retention in space 108 in piston shoe 1 or is integral with piston shoe 1; or seal 155 seals retainer 115 and piston shoe 2 against fluid losses out of fluid pocket 68. Ring 11 may swing on the adjacent member within piston bore of piston 2. Spring means 112, which may be held by retainer 113 may keep the piston shoe 1 and piston 2 together by spring force so that bearing faces 56 and 57 of piston and piston shoe may at all times be kept in pivotal, but tightly sealed engagement. By this provision any loss of time during closing as described above and any leakage of fluid therefrom can be prevented. FIG. 28 is however an expensive assembly because of the many parts involved and will therefore be used only in case of specific need. Otherwise the other piston shoes and piston piston-shoe assemblies of this invention are suitable and more inexpensive.

A further feature of this invention is keeping the fluid pressure pockets 16 in the outer faces 15 of the piston shoes as close together as possible as, if they are widely separated from each other, the piston shoe ends would be deformed by the pressure forces radially towards the pistons. That would result in big leakage losses of fluid pockets 16 toward the axial piston ends. According to this invention the fluid pockets 16 are within or almost within the axial limits of the swing member 88 in order to provide a radially rigid and undeformable piston shoe for high pressure. The desired and provided closeness of the fluid pressure pockets 16 results in the seal between them and the ring groove 24 in the actuator 33 being very short. Therefore it is important in accordance with this invention to axially align the actuator and rotor to each other with the partially embracing end members 14, as in the prior art, where actuators and rotors were axially fixed in separate sets of bearings, the axial fixing relative to each other was not accurate enough. This results in one of the fluid pockets 16 running closer to the ring groove 24 of the actuator 33. The consequence thereof is more leakage from one of the fluid pockets than from the other. In some of the prior-art devices the one fluid pocket 16 was so far axially dislocated that it came into communication with the ring groove 24 of the actuator 33. This resulted in high leakage and uneconomic operation of the device and in considerable slip.

Another important problem with the devices of the prior art was the connection of the pistons to the piston shoes and the pulling of the pistons and pistons shoes out of the cylinders by traction members. All axial piston devices have this problem and the radial piston devices had it in that traction guide faces embraced the inner faces of the ends of the piston shoes. It thereby happened in former devices that when a piston stuck in a cylinder due to heating, foreign bodies or dust, the piston was forced outward by the piston shoe connection and, since the piston stuck and could not follow this outward traction, the piston piston-shoe connection broke. The device was then completely destroyed immediately. In aircraft use of such devices, the aircraft would crash and kill the passengers or crew on board. It is therefore so important in accordance with this invention not to pull the piston shoes outwardly out of the cylinders by mechanical means, but to let them float freely in the containment space 58. If then a piston sticks in the cylinder, the device can continue to operate with the other pistons. The stuck piston or pistons and connected piston shoe then just rest in the device of this invention, and the thereby driven aircraft does not crash and the persons therein will not be killed.

It has been further discovered in accordance with this invention, that in many cases, and even in cases of pumps with self-suction mechanical traction members for pulling the pistons outwardly the mechanical traction members are not necessary. For example, the piston piston-shoe assembly of FIGS. 18 to 22 is already so heavy in average devices the centrifugal force of the piston piston-shoe assembly is even at average speed, such as 1500 rpm, sufficient to move the pistons outward and to suck the fluid in into the cylinders 10.

A very accurate and intensive test at one of the world's most advanced laboratories showed, that the device of FIGS. 18 to 22 run as motor with more than 80 percent total efficiency smoothly and reliably at the extremely low speec of 178 rpm and that it runs with over 97% mechanical efficiency and with over 94% total efficiency at 2000 rpm. It run also reliably at more than 3000 rpm. The free floating three-dimensional free-play piston shoe of the invention operated reliably at 2 to 600 atmospheres of pressure. It may be able to operate at even higher pressures. The efficiencies due to reduced friction were so high that even at only 2 atmospheres the device could be used, as well as at many hundred atmospheres. In aircraft, where life of persons is at stake, a hydraulic drive of the invention is almost a must for reliable and safe operation, especially if the hydraulic drive operates the propellers of helicopters.

Finally it has been discovered by this invention, that with pistons of very small diameter, 10 mm or less, there is not enough material left to provide a connection of reliable operation between piston and piston shoe. The invention therefore provides the unconnected piston shoe of at least one dimensional free play for small devices of pistons with little diameters and therefore for devices of only a few cc/rev.. But just these devices of very few cc flow-through per revolution are devices of many applications in the near future and also in the far future, because at the high pressure, which the devices of the invention make possible, already a few cc flow through the device pe revolution gives considerable horsepower. Also the saving in manufacturing costs due to this invention is especially important to small devices with little diameters of pistons. On the other hand, there is no limitation to the maximal size of the devices of the invention. Units in the range of 100,000 horsepower are easily built and are not even very heavy or voluminous.

In FIG. 23 the radial piston device is of the radial-flow type, wherein a central control body of cylindrical shape, represented by reference numeral 121, is located inside a central bore or hub of the rotor 9. Ports 117 supply the fluid into the respective cylinders 10 and ports 118 lead fluid out of the respective cylinders 10. In case of opposite direction of flow the ports 118 will be supply ports and ports 117 will be exit ports. The fluid flows through respective passages within control body 121.

Figure 29:
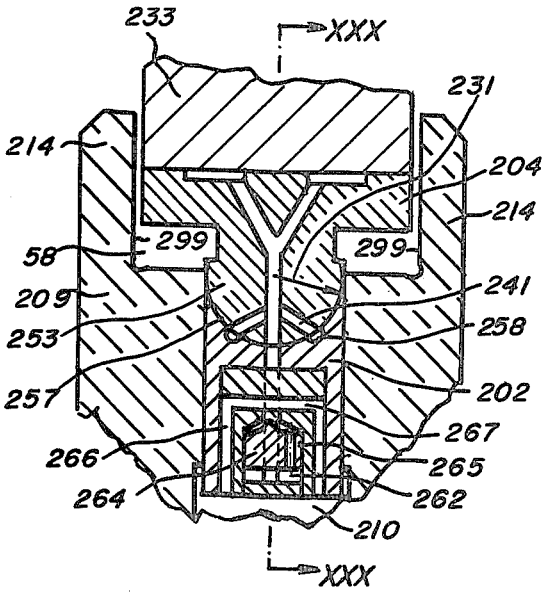
FIG. 29 is longitudinal sectional view through a portion of a rotor of a radial piston machine with a piston and shoe therein.
Figure 30:
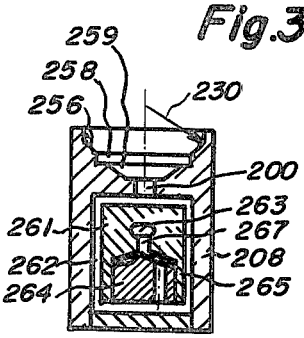
FIG. 30 is a cross-sectional view through FIG. 29 along line XXX—XXX.

In the embodiment of FIGS. 29 and 30 the rotor 209 is cut out radially from outside to form the containment space 58 between end elements 214. In this case the end elements 214 are integral with the rotor 209. The end elements 214 have the innermost radially plane faces 299, for retaining the piston shoes 201 therebetween. Rotor 209 may have slots through the outer ends of the cylinders or may have no slots through the cylinders. In the sample of the figures the cylinders have no slots through the cylinders. The radially inwardly projecting portion 253 of piston shoe 201 is at all times moving within the defines of cylinders 210 or resting therein, so, that at least a portion of the said radially inwardly projecting portion 253 remains within the space of cyliner 210. The outer face of portion 253 may be of equal or slightly smaller radius than the radius of the cylinder 210 is. This relationship of the radii to each other defines the close or non close fit or containment of the portion 253 within the wall of cylinder 210. Almost equal radii define a very closely guided move of portion 253 in cylinder 210. Thus, this arrangement may be used in rotors with slots through the cylinders for large piston stroke or in usual conventional rotors with no slots through the cylinders. Equalness of the discussed radii can provide a guided centering of the piston to the shoe and vice versa.

Figure 31:
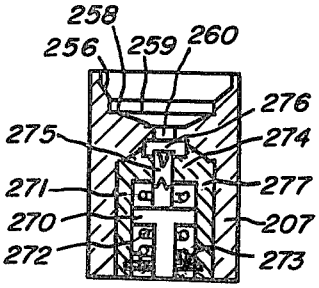
FIG. 31 is a longitudinal sectional view through another embodiment of a piston of the invention with another flow through restriction means therein.

Another specific embodiment of the discussed FIGS. 29 to 31 is, that the piston has a piston head with a part-spherical reception face wherein at least one annullar ring groove 258 and at least one narrow passage is provided. Thereby the reception face 256–259 is divided into a radially bearing piston 259 and an outer sealing portion 256 with the annullar groove therebetween. Passage means 241 lead fluid under pressure into annullar ring groove 258 and medial passage 260 is supplied with pressure fluid through the piston passage in the known way. The feature of this arrangement is, that the bearing portion 259 of the reception face 256–259 is force-lubricated from both ends. Further it is almost normal to the force of the bearing of the piston shoe on the piston. Thereby a high efficiency with little friction during pivoting or swing action of the shoe on the piston is assured. The seal face portion 256 is more parallel to the load direction and thereby sealing effectively. It is however not loaded with high load, since the high load of piston shoe onto piston or vice versa is effectively be borne by the medial bearing portion 259 under good moving and bearing angle and under forced lubrication. As narrower the medial passage 260 is, as more normal the medial inclination of the bearing portion 259 becomes and as more increases the bearing capacity and efficiency of pivoting motion of piston shoe portion 253 along the reception face 256–259 of the piston head of piston 202.

Another specific invention is the arrangement inside of piston 202. When the rotor revolves at very high revalutions the centrifugal force drives the heavy piston shoe speedy radially outwards during pressureless outward move. The piston 202 on contrary thereto has a close fit in cylinder 210 and there is friction between piston wall and cylinder wall due to the oilfilm between these walls. Further, the piston may be of less mass, then the piston shoe is. The consequences thereof are, that the piston moves relatively slower outwards, than the piston shoe does. That results in a little gap between the piston head's reception face 256, 259 and the inwardly projecting portion 253 of piston shoe 201. As soon as this gap opens fluid may flow through it. Or, when the deliverying inwards stroke of the piston shoe starts, some little time intervall is lost until the projecting portion of the piston shoe comes to a closely fitting lay on the piston head. This little time intervall has the disadventage, that during the entire length of time intervall pressure fluid escapes through the then unclosed gap between piston and shoe. This results in a considerable loss of leakage and thereby of efficiency in the machine. The losses appear to be as higher as the rpm of the device become, as tests have shown.

To prevent such escape of fluid under pressure and thereby to increase the efficiency of the machine, the flow-through restriction device is assembled in or provided to the piston 202. In case of FIGS. 29 and 30 the piston has a space 262 wherein the valve 264 can radially move. Valve 264 is adapted to centrifugal force and said force increases with higher rpm of the rotor. Valve body 264 is forced under centrifugal or spring force towards orifice 267 for sealing the same. Fluid is passed through passage(s) 266 from the respective cylinder 210 towards the orifice 267. It is stopped there by the closing action of valve 264 on orifice 267. If however the pressure in cylinder 210 exceeds a certain pressure, the pressure action of fluid through the orifice onto valve 264 is stronger, than its closing action. The valve is pressed away from the orifice 267 and opens it. Pressure fluid from cylinder 210 can than move through passage 266, through orifice 267, through passage 265 associated to valve 264 and thereafter through passage 262 and through passage 260 into the piston shoe and into the annullar groove 258 for effective lubrication and pressure balancing of the bearing portion of the piston and piston shoe.

Thus, the valve 264 opens the communication between passage 260 at high pressure and closes it at lower pressure. That results therein, that pre-pressure can be used in pumps in order to force the piston 202 as fast outwards as the piston shoe moves outward. The appearance of a gap between piston and shoe and leakage therethrough is thereby prevented. Another feature of this arrangement is, that the opening pressure is as higher, as higher the rpm are, since higher rpm make higher centrifugal forces acting on the valve 264.

Thus, valve body 264 and the thereto associated passages or means assure a closing of the passage 264 at the pump-intake stroke under pre-pressure in fluid and assure thereby a gap-less and leakage-less outward move of piston and piston shoe during pressurized fluid flow into the pump at intake stroke and by the same means it is assured, that the passage 260 is open at the higher pressure delivery piston stroke of the pump, whereby good lubrication during the pivote-motion of the piston shoe on the piston under high load is assured.

The arrangement discussed above in relation to FIGS. 29 and 30 is very highly effective. It entirely prevents the leakage through the gap, because it prevents the gap. Said leakage was called by the inventor the "closing time loss" in order to show, that the time needed to close the discussed gap made said leakage. The said closing time loss had reached so considerable proportions at high rpm of pumps, that their efficiency decreased more than tolerable. The above described arrangement has very effectively fully prevented such closing time loss and thereby effectively increased the efficiency of the pump at highest rpm. This feature was never achieved before for such high rpm of pump. Because at high rpm of pumps the heretofore used piston-piston shoe connection broke and disturbed the pump.

At other application, when the centrifugal-force-operated valve of FIGS. 29–30 is not available, the valve of FIG. 31 may be assembled in piston 202. A sealing piston end 275 is closely sealing axially moveable located in controlling and sealing cylinder portion 274 in piston 202. Sealing piston end 275 is the control portion of piston-orifice controller 270. Control portion 275 has on each end a recess. At one end recess 276 and at the other end recess 277. Spring means 271 and 272 on both ends of the holding portion 270 keep the control portion 275 in closing position within cylindrical seal portion 274. Body 270 or the associated springs may be retained by holder means 273 in piston 202. If pressure in fluid increases on one end of the piston higher than the pressure on the other end of the piston 202 is, the control portion is pressed against the respective spring 271 or 272, compressing the same and moving one of the recesses 276 or 277, depending on the direction of higher pressure, so far away from the centred position, that the respective recess 276 or 277 opens respective to seal portion 274 and thereby opens the flow through of fluid through the piston 202. When the pressures are equalized on both radial ends of the piston 202 the springs 271 and 272 presse the control portion 275 again into sealing position in seal portion 274. By the above described mechanism the action of the assembly of FIG. 31 is also very effective to prevent closing time losses and at same system to assure good fluid supply for forced lubrication at the high-pressure inward stroke in a pump.

Figure 32:
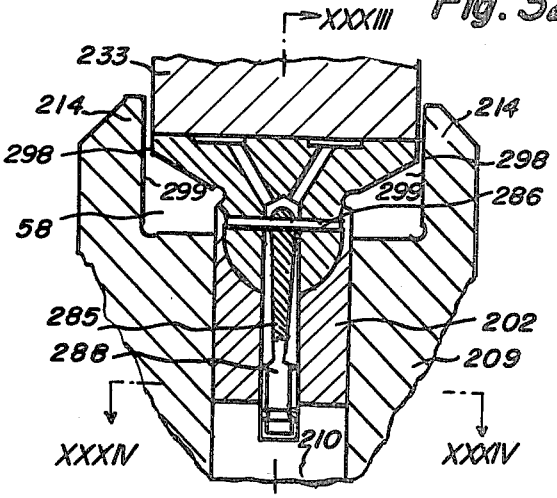
FIG. 32 is another longitudinal sectional view through a portion of a rotor of a radial piston machine with another embodiment of a piston and piston-shoe assembly of the invention therein.
Figure 33:
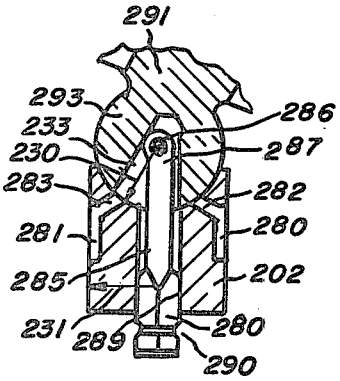
FIG. 33 is a cross-sectional view through FIG. 32 along line XXXIII—XXXIII.
Figure 34:
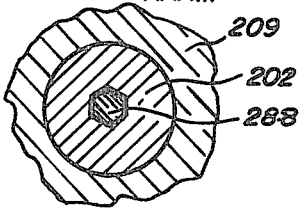
FIG. 34 is a cross-sectional view through FIG. 32 along line XXXIV—XXXIV.

The embodiment of the invention shown in FIGS. 32 to 34 is specially suitable for high pressure motors or for self-suctioning pumps or compressors.

A self-suctioning pump prefers a piston and piston-shoe assembly, where piston and shoe are connected together, so, that they can not depart away from each other. Because the self-suctioning pump has no pre-pressure in the suction line. The piston can not be pressed radially outward by fluid. On contrary, it has to serve to take in fluid.

When such self-suctioning pump shall operate under the highest pressure, however, the highest cross-sectional area of bearing portion between piston and piston shoe is desired. That prevents embracement of piston and shoe relativey to each other, because embracement arrangements would take too much area on the outer portions of the pistons away from bearing purposes.

When the device acts as a motor or as a pump under very high pressure, the pivoting of the piston shoe provides a tangentially directed force-component on the piston, whereby piston 202 is pressed one-sided against the wall of the cylinder. This appearance is generally known from earlier patents of inventor, but there were no means heretofore to prevent such appearance at pistons with part-spherical heads.

Due to the arrangement of said FIGS. 32 to 34 it is now however possible in accordance with this invention to provide and operate tangentially pressure balancing pockets 281 and 282 also in pistons with part-spherical piston heads. Control-recess 233 in radially inward projecting portion 293 opens and closes passages 283 and 282 to pockets 281 and 280 during the pivoting motion of portion 293 similarily as in inventor's U.S. Pat. No. 3,225,706. Such action can be effective however only, if the piston is prevented from rotation relatively to the piston shoe. In order to achieve this, the holding pin 285 is provided in piston 202 and shoe portion 293. Holding pin 285 has a preferably ball-formed head 287 and extends therewith into a bore in piston shoe portion 293. It is pivotably fastened therein by cross-pin 286 whereby relative rotation between pin 285 and shoe portion 293 is prevented. The piston 202 is provided with a profiled recess 289 and pin end 288 is complementary profiled, so, that pin end 288 can axially move in profiled piston portion 289 but is prevented from rotation therein. In the figures the profile is shown as of sixangular cross-section, especially demonstrated in FIG. 34. But the profile can be of any other suitable configuration which prevents rotation of the piston 202 around the pin 285. A retainer means 290 may be provided in order to retain springloaded or non-springloaded the piston 202 on pin 285. In such case, the piston and piston shoe are connected together by pin means 285 and the thereto associated means.

If no retainer is set to retainer 290, the piston and shoe remain un-connected relatively to each other. The free-floating of the piston shoe remains. Because the profiled portion 288 can freely move radially in the machine, which is axially in the piston 202. When piston shoe portion 293 moves radially away from the piston 202 and the said gap opens, the pin means 285 moves within said piston 202. Piston and shoe remain thereby radially free of each other, while prevention of relative rotation between piston and shoe remains prevented. Control of flow into tangential balance pockets 281 and 280 is immediately assured again, when the gap between piston and shoe is closed again. The correct direction and location of pockets 280 and 281 relatively to the wall of the cylinder 210 is assured by the means of FIGS. 32 to 34 or by similar effective arrangements.

Equalness or almost equalness of radii 230 and 231 assures closely guided co-axial move of piston and shoe in cylinder 210. Innermost faces 299 on end elements are radially plane faces without any extensions inwardly beyond said plane faces. Thereby it is assured, that either the piston shoes alone, if they are unconnected to the pistons, or the piston and piston shoe assemblies, when pistons and shoes are connected to each other can move unhindered by end elements freely radially between said innermost faces 288 of end elements 214. To prevent axial de-location of piston shoes the end faces 298 of the piston shoes may get respectively close or non-close fits relatively to the said innermost faces 299. Another means for prevention of dislocation of piston shoes is the equalness or almost equalness of radii 230 and 231 of the respective piston head and of the respective radially inwardly projecting portion of the respective piston shoe.

What is claimed is:

1. A radial piston type fluid machine;

comprising a housing, a rotor member rotatably mounted in said housing about a rotor axis and formed with a plurality of angularly spaced and radially outwardly opening cylinders;

a piston radially displaceable in each of said cylinders and having a piston head forming a reception face of a configuration of a radius around a common centre;

a piston shoe associated to each of said pistons and having a radially inwardly projecting portion provided partially with a configuration complementary to that of said reception face and with a radius substantially equal to that of said reception face and around said common centre;

said radially inwardly projecting portion of said piston shoe able to radially engage said reception face of said piston head of the respective piston to be borne thereon and able to pivot thereon;

an actuator ring member radially outward of said rotor member, pistons and piston shoes; said actuator member guiding the strokes of said radially displaceable pistons and of said piston shoes; a pair of end elements carried on one of said members and flanking said piston shoes; said pistons and piston shoes remaining radially moveably contained between said rotor member, said actuator ring member and said end elements, and, wherein said common centre is located in said portion, wherein said reception face exceeds eighty percent of the crossectional area of the respective piston;

wherein said reception face embraces a respective portion of said portion by an angle from said common centre of less than 181 degrees;

wherein said piston forms a first axis longitudinally through said piston;

wherein said rotor member forms a second axis normal to said first axis;

wherein said portion contains a first bore through said common centre along a third axis normal to said first axis and parallel to said second axis;

wherein said piston contains a second bore extending longitudinally through said piston along said first axis and forming an opening in said piston head;

wherein said portion includes a third bore normal to said first bore and through said common centre and through said first bore;

wherein a first pin means is provided in said second bore in said piston and extends into said third bore in said portion and through said first bore and through said common centre;

wherein said first pin means has a pin head and a fourth bore extending through said pin head along said third axis;

wherein a second pin means is inserted through said fourth bore in said pin head into said first bore in said portion;

wherein holding means are provided in said second bore in said piston;

wherein said holding means are engaged to said piston and to said first pin means for holding said first pin means on said piston;

wherein a limited space is provided in said portion around said first pin means and said pin head for permittance of movement of said first pin means within said limited space;

wherein said pin head is able to pivot relatively to said second pin means and relatively to said piston shoe and to said portion;

wherein at least one recess extends through said reception face into said piston head; and wherein a communication passage is provided from the respective of said cylinders through at least said piston to said recess for leading fluid under pressure from said cylinder into said recess for lubrication of said reception face and of said configuration of said portion whereby the holding of said portion on said piston by outer diameter portions of said piston is excluded for the purpose of utilizing a maximum of the cross-sectional area of said piston for bearing the radial load of pressure in fluid on said piston and thereby assuring high power and efficiency of the fluid machine.

2. The fluid machine of claim 1, wherein said piston includes recesses extending from said second bore into said piston;

wherein said first pin means includes a retainer means;

wherein said retainer means is received in said recesses; wherein said recesses are unround respective to said first axis, wherein the cross-sectional area of said retainer is substantially equal to the cross-sectional area of said recesses; wherein said cross-sectional areas prevent rotation of said piston relatively to said first pin means, and wherein said second pin means in said portion is closely fitting in said fourth bore of said pin head for prevention of rotation of said first pin means relatively to said piston shoe for the prevention of rotation of said piston relatively to said piston shoe.

3. The fluid machine of claim 2, wherein said portion has the form of a portion of a ball and said reception face has the form of a portion of a hollow ball, whereby rotation of said partially ball-formed portion around said first axis is prevented.

4. The fluid machine of claim 2, wherein said piston has at least one fluid pressure pocket extending from the outer diameter of the piston partially into said piston and at least one communication passage extending from said reception face through said piston to said fluid pressure pocket while said pins and said cross-sectional areas of said retainer and of said recesses maintain the angular alignment of said communication passage relatively to said limited space of said portion of said piston shoe.

* * * * *